US011077989B2

(12) United States Patent
DeRue et al.

(10) Patent No.: US 11,077,989 B2
(45) Date of Patent: Aug. 3, 2021

(54) SLIDER DEVICE, ZIPPER CLOSURE SYSTEM, AND METHODS OF USE

(71) Applicant: Reynolds Presto Products Inc., Lake Forest, IL (US)

(72) Inventors: Nicholas DeRue, Farmington, NY (US); Gregg Thompson, Canandaigua, NY (US); Joel A. Rawluszki, Canandaigua, NY (US)

(73) Assignee: Reynolds Presto Products Inc., Lake Forest, IL (US)

( * ) Notice: Subject to any disclaimer, the term of this patent is extended or adjusted under 35 U.S.C. 154(b) by 0 days.

(21) Appl. No.: 16/449,036

(22) Filed: Jun. 21, 2019

(65) Prior Publication Data

US 2020/0399025 A1 Dec. 24, 2020

(51) Int. Cl.
*B65D 33/25* (2006.01)
*A44B 19/26* (2006.01)

(52) U.S. Cl.
CPC ..... *B65D 33/2591* (2013.01); *A44B 19/267* (2013.01)

(58) Field of Classification Search
CPC ..... B65D 33/2591; A44B 19/267
See application file for complete search history.

(56) References Cited

U.S. PATENT DOCUMENTS 5,020,194 A * 6/1991 Herrington ..... B65D 33/2591 24/389
5,722,128 A * 3/1998 Toney ..... B65D 33/2591 24/399
5,833,791 A 11/1998 Bryniarski et al.
5,867,875 A * 2/1999 Beck ..... B65D 33/2591 24/400
5,896,627 A * 4/1999 Cappel ..... B65D 33/2591 24/400
5,947,603 A 9/1999 Tilman
(Continued)

FOREIGN PATENT DOCUMENTS

EP 2050684 A2 4/2009
JP 2016016898 A 2/2016
(Continued)

OTHER PUBLICATIONS

Color Photo showing Pouch closed, plow hits end stop (Publicly known prior to Jun. 21, 2019).
(Continued)

*Primary Examiner* — Robert Sandy
*Assistant Examiner* — David M Upchurch
(74) *Attorney, Agent, or Firm* — Merchant & Gould P.C.

(57) ABSTRACT

A slider zipper closure system includes a zipper closure with complementary profiles of opposing tracks for interlocking and unlocking; the closure a first end stop and a second end stop positioned opposite ends of the closure. A slider device is positioned on the zipper closure between and engaging the first end stop and second end stop to selectively: (i) unlock the complementary profiles as the slider device is moved along the tracks in an opening direction; and (ii) interlock the complementary profiles as the slider device is moved along the tracks in a closing direction. The slider device has a first end stop engagement surface positioned inboard from the closing end and adapted to strike the first end stop.

29 Claims, 14 Drawing Sheets

(56) References Cited

U.S. PATENT DOCUMENTS 6,306,071 B1 * 10/2001 Tomic ..... B65D 33/2591 493/114
6,376,035 B1 * 4/2002 Dobreski ..... B65D 33/2591 383/64
6,385,818 B1 5/2002 Savicki
6,439,770 B2 * 8/2002 Catchman ..... B65D 33/065 383/5
7,416,340 B2 8/2008 Schneider
2003/0000050 A1 * 1/2003 Blythe ..... B65D 33/2591 24/399
2003/0217444 A1 * 11/2003 Blythe ..... B65D 33/2591 24/399
2005/0054504 A1 * 3/2005 Haws ..... B65B 61/188 493/213
2005/0115033 A1 * 6/2005 Blythe ..... A44B 19/267 24/415
2006/0171610 A1 * 8/2006 Buchman ..... B65D 33/2591 383/64
2007/0193000 A1 * 8/2007 Cameron ..... B65D 33/2591 24/30.5 R
2012/0269460 A1 * 10/2012 Gong ..... B65D 33/2591 383/64
2014/0298757 A1 * 10/2014 Chapek ..... B65D 50/00 53/492
2019/0161243 A1 * 5/2019 Thompson ..... B65D 33/2591

FOREIGN PATENT DOCUMENTS

WO 9428752 A1 12/1994
WO 0076341 A1 12/2000

OTHER PUBLICATIONS

Color Photo showing Pouch open, plow hits end stop & overlaps weld. (Publicly known prior to Jun. 21, 2019).
Color Photo showing Plow stop slider 1; (Publicly known prior to Jun. 21, 2019).
Color Photo showing Plow stop slider 2; (Publicly known prior to Jun. 21, 2019).
Color Photo showing Plow stop slider 3; (Publicly known prior to Jun. 21, 2019).
Color Photo showing Plow stop slider 4; (Publicly known prior to Jun. 21, 2019).

* cited by examiner

SLIDER DEVICE, ZIPPER CLOSURE SYSTEM, AND METHODS OF USE

TECHNICAL FIELD

This disclosure relates to a slider device and a recloseable zipper closure useable with a bag or pouch. More particularly, this disclosure relates to a slider device and closure system having an end stop overlap or end termination mechanism for increasing an opening size of the mouth of the zipper closure.

BACKGROUND

Manufacturers of household products have increasingly replaced rigid packages with recloseable flexible packages due to the advantages offered by these flexible packages that include: less packaging material, lower package cost, reduced storage space, and lower shipping costs. The addition of slider devices to flexible closures has made bags easier to open and close. Packages using recloseable closures with slider devices will have end stops on each end of the closure to prevent the slider device from falling off of the end of the closure.

One problem with recloseable closures is a resulting restricted open mouth width available to access the contents of the package due to the space occupied by the two end stops and the slider. The mouth width needs to be sufficiently large for the hand or fingers of an adult to enter the small package and remove the contents. Thus, there is a need to reduce the space occupied by the two end stops and the slider device to increase the open mouth width.

SUMMARY

In one aspect, a slider device for selectively interlocking and unlocking complementary profiles of opposing tracks of a plastic zipper closure is provided. The slider device includes a top member with an opening end and an opposite closing end; and a pair of spaced legs depending from the top member; the spaced legs defining an open volume therebetween to allow for passage of the tracks therethrough and with the legs having terminal ends straddling the tracks. The top member has an internal surface within the open volume between the legs; the internal surface including at least a first region and a second region; the first region extending from the closing end partially along the internal surface of the top member; and the second region being between the first region and the opening end; the first region extending at a greater distance from the terminal ends of the spaced legs than the second region. Internal surfaces are spaced sufficiently close together to press the profiles into interlocking relationship as the slider is moved in a closing direction along the zipper closure leading with the opening end and trailing with the closing end. A separator plow extends from the second region of the top member into the open volume between the legs; the separator plow being positioned to wedge between opposing tracks and unlock the profiles as the slider device is moved in an opening direction along the zipper closure leading with the closing end and trailing with the opening end. The second region of the top member includes an engagement surface positioned to strike an end stop on at least one end of the zipper closure.

In some examples, the engagement surface is located between the separator plow and the first region.

In example embodiments, the legs each have internal facing hooks at their respective terminal ends.

The hooks can extend an entire length of the slider between the opening end and closing end.

Some embodiments included the engagement surface being a portion of the separator plow.

In one or more examples, there is a leg engagement surface extending from an internal surface of each of the legs.

For some embodiments, the hooks extend from the opening end only a partial length of the slider toward the closing end.

In some embodiments, the hooks extend only along the portions of the legs that are along the second region of the top member.

The second region extends from the opening end, in some embodiments.

In one or more example embodiments, a first pointed projection extends from the engagement surface partially toward the closing end.

In examples, the internal surface of the top member further includes a third region; the third region extending from the opening end, with the second region being between the third region and the first region; and the third region extends at a greater distance from the terminal ends of the spaced legs than the second region.

In one or more embodiments, the third region and the first region extend a same distance from the terminal ends of the spaced legs.

In some examples, there is further including a second pointed projection extending from the second region partially toward the opening end.

In another aspect, a slider zipper closure system is provided including: a recloseable zipper closure with complementary profiles of opposing tracks for interlocking and unlocking; the closure having a first end and an opposite second end; a first end stop positioned at the first end of the closure; a second end stop positioned at the second end of the closure; and a slider device having a closing end and an opposite opening end; the slider device slidably positioned on the zipper closure between and engaging the first end stop and second end stop to selectively: (i) unlock the complementary profiles as the slider device is moved along the tracks in an opening direction leading with the closing end and trailing with the opening end; and (ii) interlock the complementary profiles as the slider device is moved along the tracks in a closing direction leading with the opening end and trailing with the closing end; and the slider device having a first end stop engagement surface positioned inboard from the closing end and adapted to strike the first end stop.

In one or more example embodiments, the slider device includes a top member; a pair of spaced legs depending from the top member; the spaced legs defining an open volume therebetween with passage of the tracks therethrough and with the legs having terminal ends straddling the tracks; the top member having an internal surface within the open volume between the legs; the internal surface including at least a first region and a second region; the first region extending from the closing end partially along the internal surface of the top member; the second region being between the first region and the opening end; the first region extending at a greater distance from the terminal ends of the spaced legs than the second region. The slider device further includes internal surfaces spaced sufficiently close together to move the profiles into interlocking relationship as the slider is moved in the closing direction; a separator plow extending from the second region of the top member into the open volume between the legs; the separator plow adapted to wedge between opposing tracks and unlock the profiles as the slider device is moved in the opening direction along the zipper closure leading with the closing end and trailing with the opening end; and the second region of the top member including the first end stop engagement surface positioned to strike the first end stop, when the zipper closure has been unlocked.

In example embodiments, the first end stop and the second end stop are each an inverted U-clip.

The first end stop engagement surface is a portion of the separator plow, in some embodiments.

In some examples, the first end stop engagement surface is between the separator plow and the closing end.

The opening end of the slider device engages against the second end stop, when the zipper closure has been interlocked, in example embodiments.

In some implementations, the first end stop and second end stop are each formed fins projecting above a top of the tracks.

In example embodiments, the slider device may further include a first pointed projection extending from the first end stop engagement surface partially toward the closing end and capable of digging into the first end stop.

In some embodiments, the internal surface of the top member further includes a third region; the third region extends from the opening end, with the second region being between the third region and the first region; and the third region extends at a greater distance from the terminal ends of the spaced legs than the second region.

The third region and the first region extend a same distance from the terminal ends of the spaced legs, in many example embodiments.

In one or more embodiments, there further includes a second pointed projection extending from the second region partially toward the opening end and digging into the second end stop.

In another aspect, a method of operating a zippered flexible package having an openable and recloseable mouth is provided. The method includes providing a zippered flexible package having a recloseable zipper closure at the mouth including opposing tracks with complementary profiles for interlocking and unlocking; the complementary profiles interlocking to close the mouth and unlocking to open the mouth; first and second end stops on opposite ends of the zipper closure; a slider device located on the zipper closure; the slider device having a closing end and an opposite opening end and a first end stop engagement surface positioned inboard from the closing end; and opening the mouth by moving the slider device along the tracks leading with the closing end and trailing with the opening end to unlock the complementary profiles until the first end stop engagement surface strikes the first end stop.

In example methods, the step of striking the first end stop includes striking an inverted U-clip forming the first end stop.

Some implementations further include a step of closing the mouth by moving the slider device along the tracks leading with the opening end and trailing with the closing end to interlock the complementary profiles until the opening end of the slider device strikes an inverted U-clip forming the second end stop.

The step of striking the first end stop can include digging a first pointed projection extending from the first end stop engagement surface partially toward the closing end into a fin forming the first end stop.

Some example methods further include closing the mouth by moving the slider device along the tracks leading with the opening end and trailing with the closing end to interlock the complementary profiles until a second pointed projection positioned inboard from the opening end digs into a fin forming the second end stop.

A variety of examples of desirable product features or methods are set forth in the description that follows, and in part, will be apparent from the description, or maybe learned by practicing various aspects of this disclosure. The aspects of this disclosure may relate to individual features as well as combinations of features. It is to be understood that both the foregoing general description and the following detailed description are explanatory only, and are not restrictive of the claimed invention.

DETAILED DESCRIPTION

A. Example Package with Zipper Closure and End Stops

Figure 19:
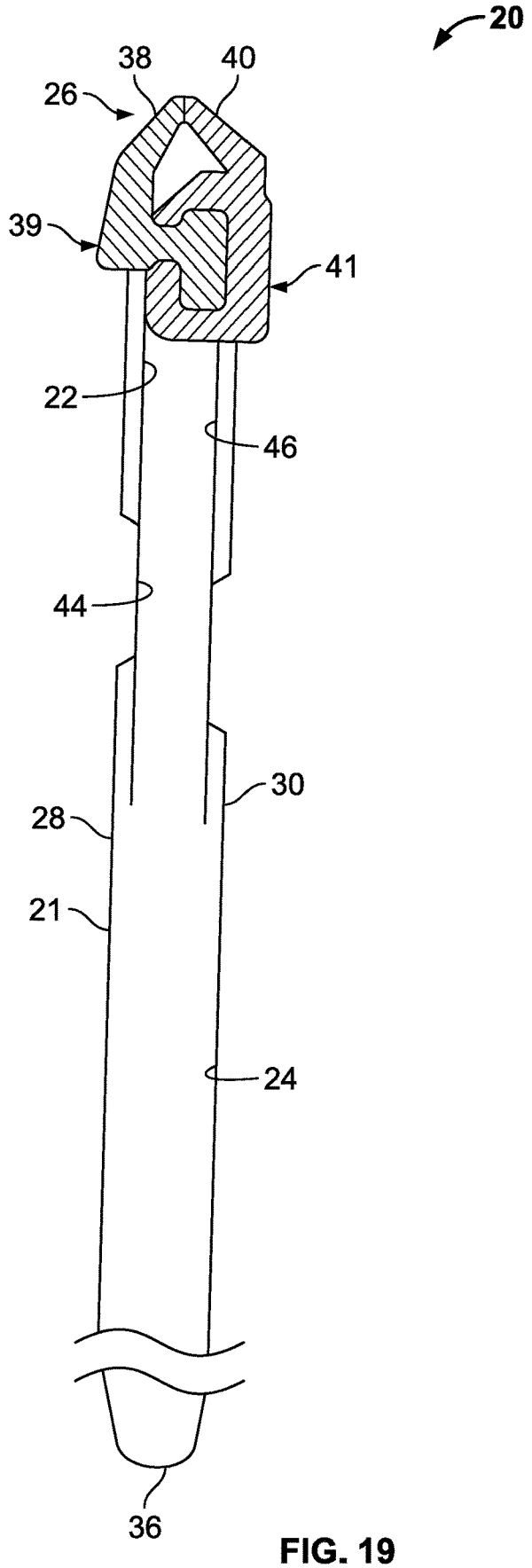
FIG. 19 is a schematic, cross-sectional view of a zipper closure and bag usable with any of the slider zipper closure systems described herein.

Referring first to FIG. 19, there is illustrated one non-limiting example embodiment of a flexible package 20. The package 20 can be a plastic bag 21 made of, for example, a polymeric material. The package 20 has a mouth 22 that provides access to a package interior 24. The mouth 22 is repeatedly openable and recloseable with a zipper closure 26.

Figure 1:
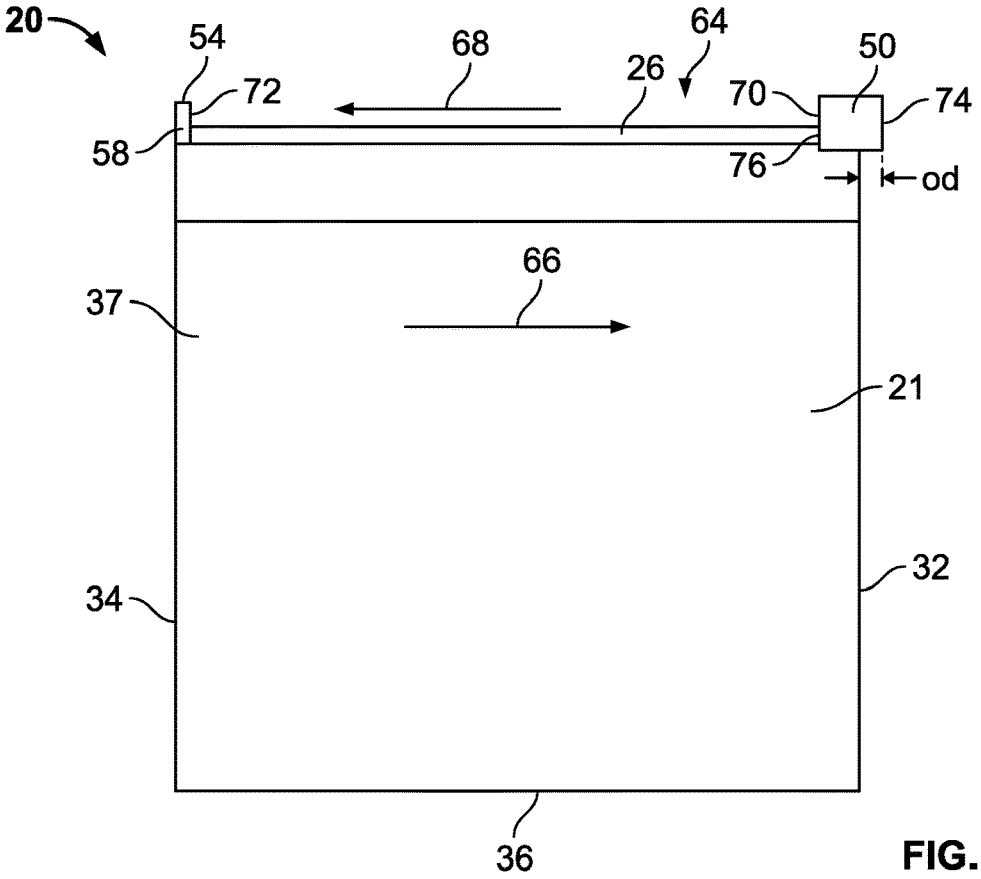
FIG. 1 is a front elevational view of a first embodiment of a flexible package having a slider zipper closure system, constructed in accordance with principles of this disclosure.
Figure 2:
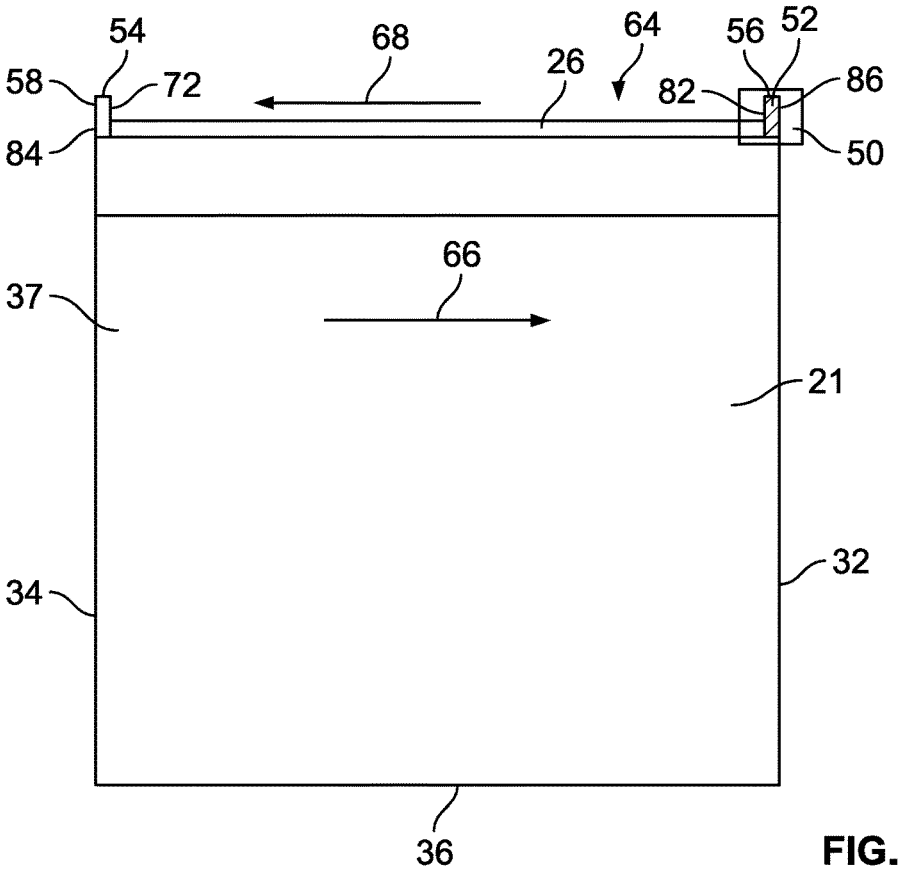
FIG. 2 is the same view as FIG. 1, but with the slider device transparent to reveal internal structure.

In the example embodiment, and in reference now to FIGS. 1 and 2, the bag 21 is formed from a single flexible plastic sheet folded upon itself, although many variations are possible. The bag 21 has first and second opposing body panels 28, 30. Body panels 28, 30 are fixedly connected to each other along a pair of side edges 32, 34 and a bottom 36. The side edges 32, 34 are often formed by heat sealing together the opposed body panels. The bottom 36 extends between the pair of side edges 32, 34 and is often embodied as a fold in the plastic sheet. In other embodiments, the bottom 36 can also be a heat sealed edge, if, for example, two separate pieces of a plastic sheet are used and then attached to each other. The flexible package 20 can include many variations such as: side gussets, bottom gussets, stand-up pouch, etc.

The zipper closure 26 is illustrated as extending along the mouth 22 at the opposite of the bottom 36 of the bag 21, but many other arrangements are possible. The body panels 28, 30 and bottom 36 form a surrounding wall 37 of the bag 21.

The zipper closure 26 includes complementary profiles of opposing tracks 38, 40, which can interlock together to close the mouth 22; or, unlock from each other to open the mouth 22. Many different embodiments are possible for the opposing tracks 38, 40. In the example shown, the track 38 has a male profile 39, and the track 40 has a female profile 41. The cross-sectional shapes of the interlocking male and female profiles 39, 41 are described in U.S. Pat. No. 5,007,143, which is incorporated herein by reference. The male and female profiles 39, 41 have complementary cross-sectional shapes and are closed by pressing a bottom of the elements together first and then rolling the elements to a closed position toward the top thereof. Many alternatives can be used.

While many different embodiments are possible, in the example shown in FIG. 19, the tracks 38, 40 are made by an extrusion process, each having a fin 44, 46 and attached (typically by a heat seal, but adhesive or other ways are possible) to the respective body panels 28, 30 on opposite sides of the bag mouth 22.

The zipper closure 26 is openable and recloseable with a slider device 50 (FIG. 1). The slider device 50 selectively interlocks and unlocks the complementary profiles of opposing tracks 38, 40, by moving the slider device 50 relative to the zipper closure 26. Various example embodiments of slider devices 50 are described herein. Typically, the slider devices 50 described are molded as a single piece of plastic, although alternatives are possible.

The zipper closure 26 has at opposite ends, terminations or end stops 52, 54 (FIG. 2). The termination 52 is also along the side edge 32, while the termination 54 is along the side edge 34, although the end terminations 52, 54 do not necessarily need to be at the side edges 32, 34. End terminations 52, 54 can have various purposes such as (a) preventing or inhibiting the slider device 50 from going past the ends of the closure 26; (b) interacting with the slider device 50 to give a tactile indication of being closed; (c) assisting in inhibiting or preventing leakage from the package 20; and (d) holding the opposing tracks 38, 40 together to provide additional strength in resisting stresses applied to the tracks 38, 40 during normal use of the package 20.

Many different types of end stops 52, 54 are possible including flexible clips 56, 58 (FIGS. 1-3) that can be mounted on the closure tracks 38, 40 automatically with suitable insertion equipment, or manually. The clips 56, 58 can be in the form of plastic, molded U-clips that are wrapped around the tracks 38, 40 and fused thereon using many example methods, such as ultrasonically, with adhesive, or with heat. Further description of useable clips 56, 58 may be obtained from U.S. Pat. No. 5,067,208, incorporated herein by reference.

Figure 4:
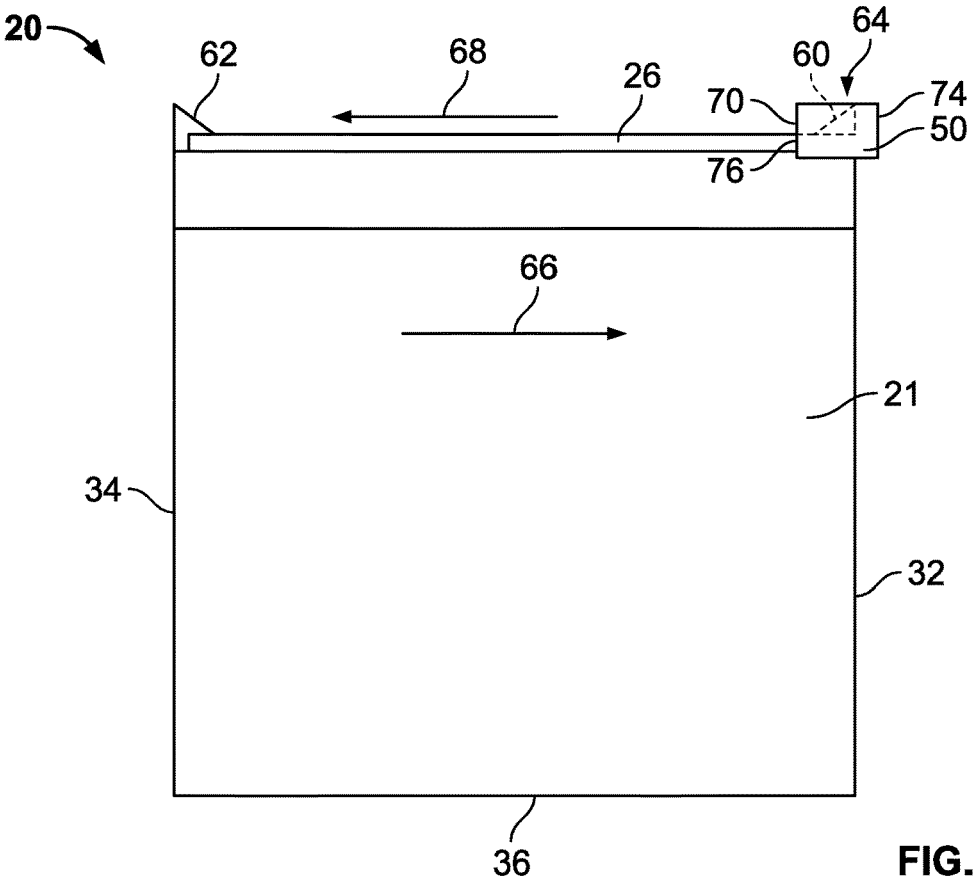
FIG. 4 is a front elevational view of another embodiment of a flexible package having a slider zipper closure system, constructed in accordance with principles of this disclosure.
Figure 5:
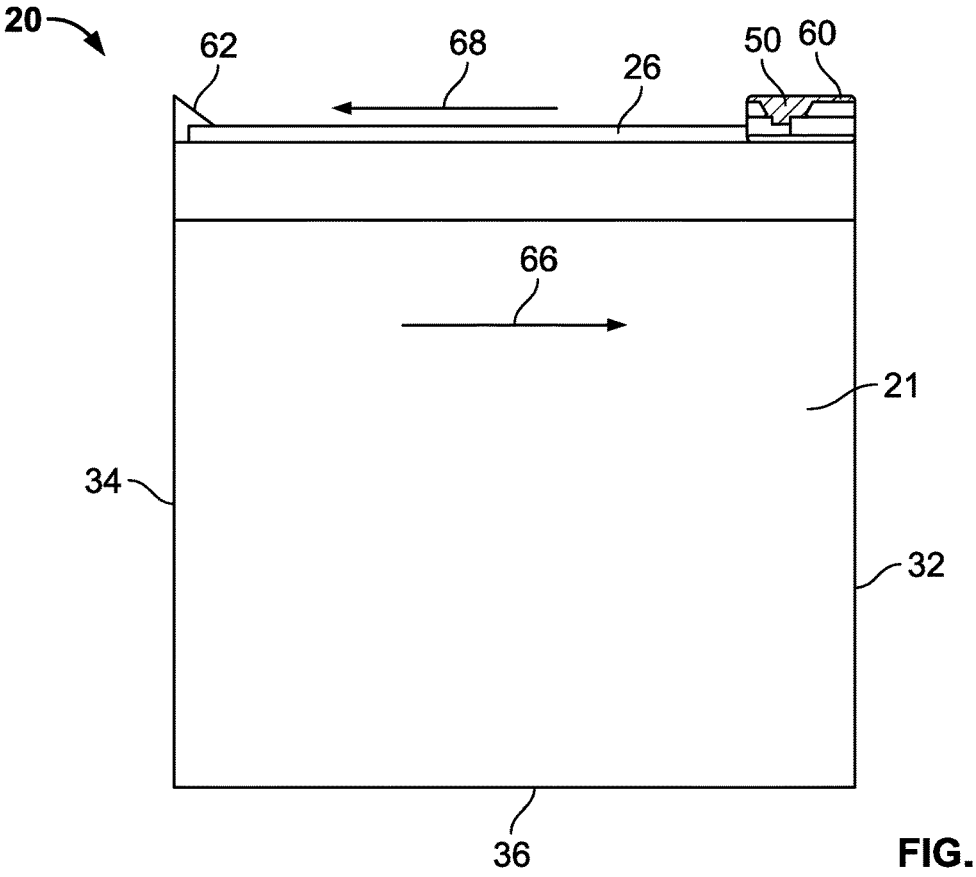
FIG. 5 is the same view as FIG. 4, but revealing internal components of the slider device and end stop structure of the zipper closure.
Figure 9:
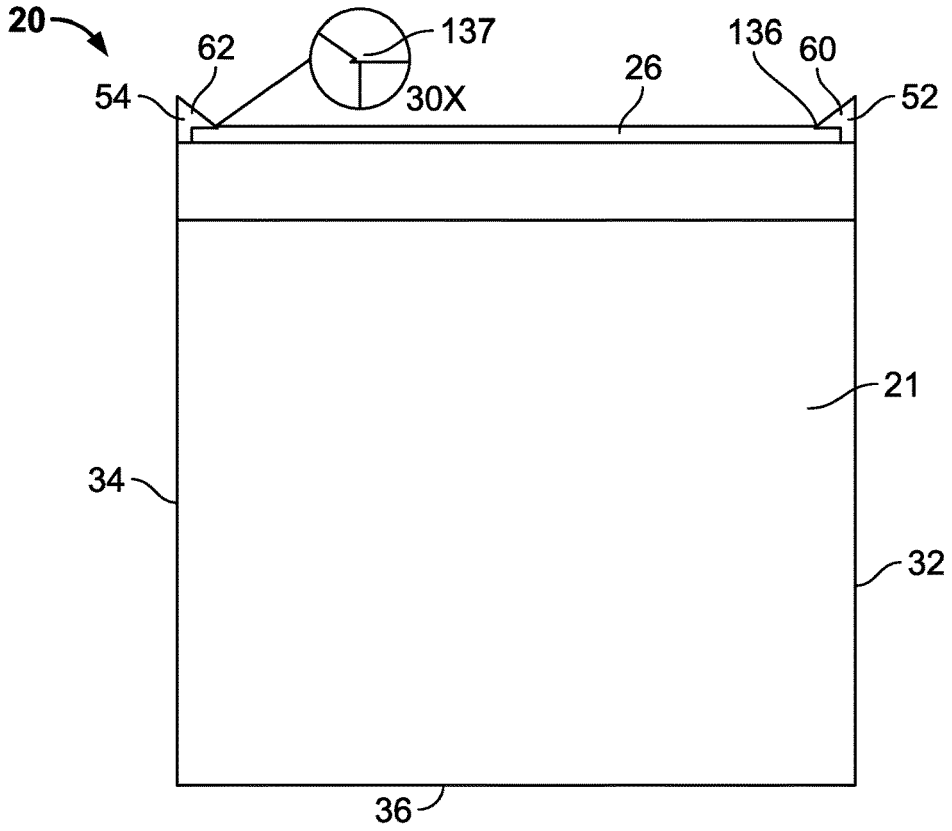
FIG. 9 is a front elevational view of the flexible package and zipper closure of FIGS. 4 and 5, but without the slider device positioned thereon.
Figure 10:
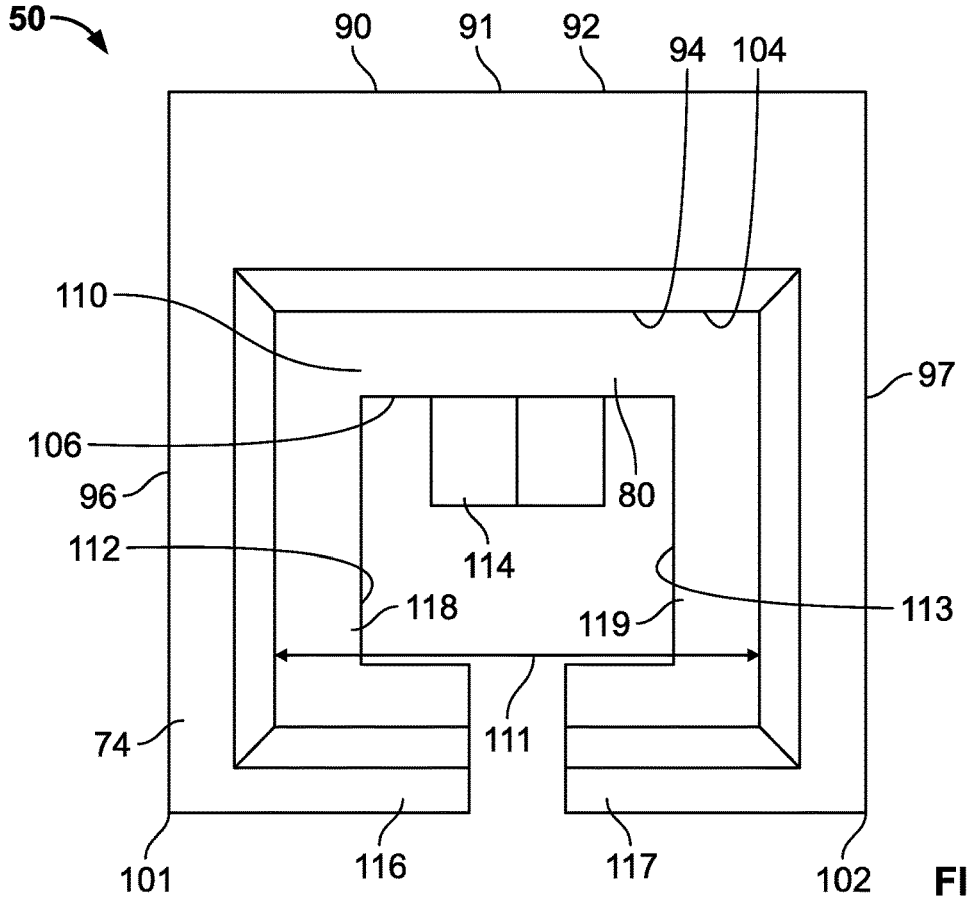
FIG. 10 is an end view of another embodiment of a slider device usable with the slider zipper closure system of FIGS. 1 and 2.
Figure 11:
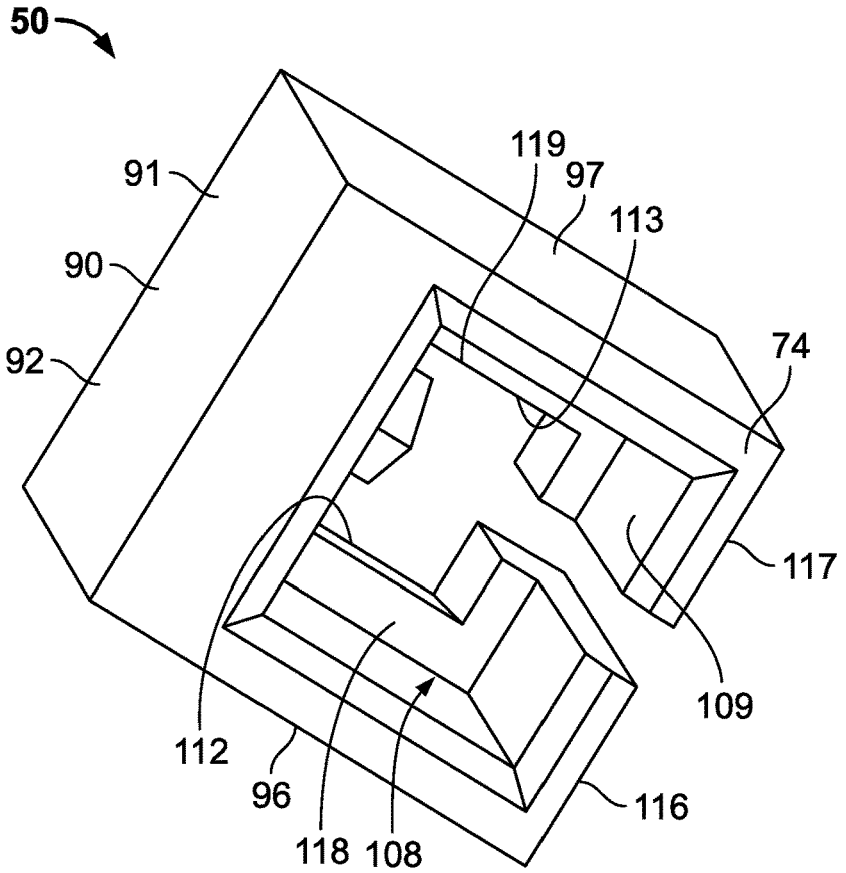
FIG. 11 is a perspective view of the slider device of FIG. 10.
Figure 12:
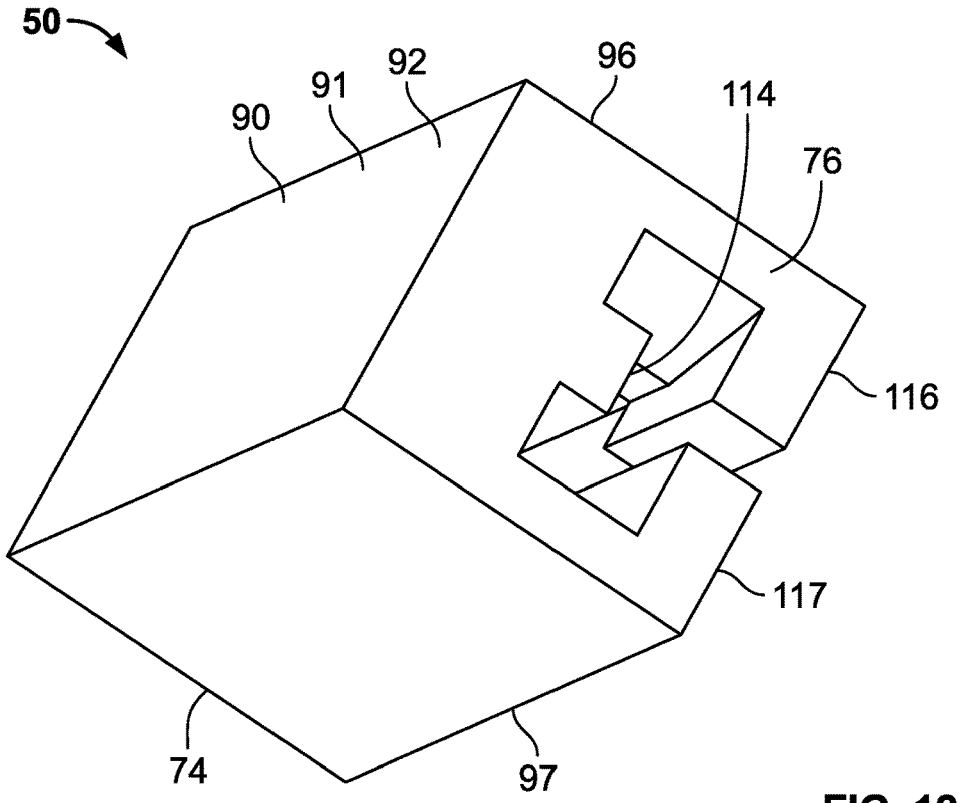
FIG. 12 is another perspective view of the slider device of FIG. 10.
Figure 13:
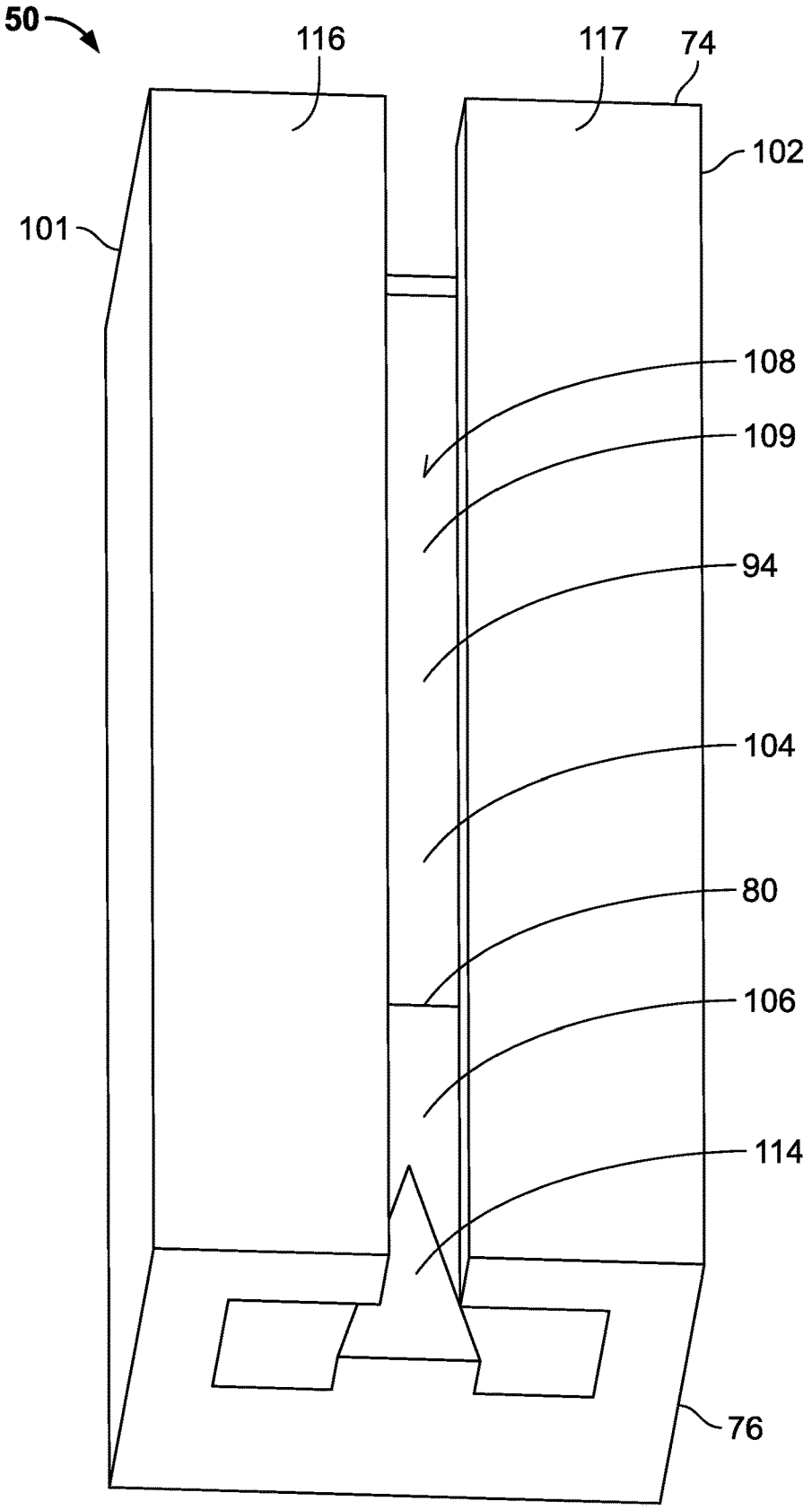
FIG. 13 is another perspective view of the slider device of FIG. 10.

Other types of end stops 52, 54 include terminations made from ultrasonic crushing or welding that results in ultrasonic fins 60, 62 (FIGS. 4, 5, 9). Further description of techniques that can be used to make ultrasonic fins for end stops can be obtained from U.S. Pat. No. 7,267,856, incorporated herein by reference.

B. The Embodiments of FIGS. 1-3 and 10-18

Figure 3:
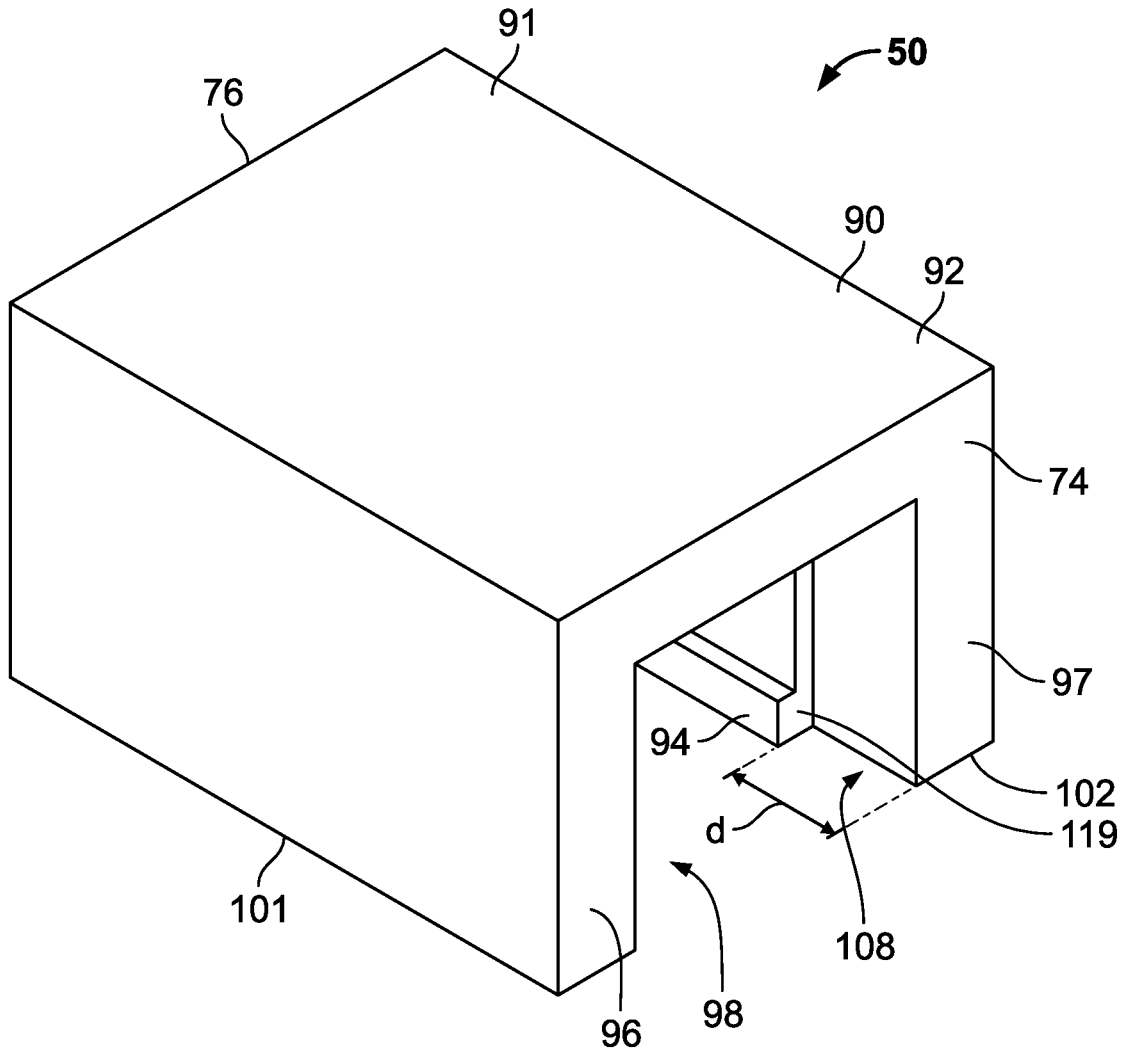
FIG. 3 is a perspective view of one embodiment of the slider device used in FIGS. 1 and 2.

In the embodiment of FIGS. 1-3, the package 20 has a slider zipper closure system 64. The slider zipper closure system 64 includes the zipper closure 26 and the slider device 50 slidably positioned on the zipper closure 26. The slider device 50 is slidably movable between the end stop 52 (FIG. 2) and the end stop 54. When the slider device 50 is moved in an opening direction 66, the complementary profiles 39, 41 are disengaged or unlocked to provide access to the interior 24 of the bag 21 through the mouth 22. When the slider device 50 is moved in a closing direction 68, the complementary profiles 39, 41 are interlocked to close the mouth 22 and prevent access to the interior 24.

In FIGS. 1 and 2, the slider device 50 is shown in a position after the closure 26 has been opened. The slider device 50 is straddling the end clip 56 (FIG. 2) and, in the example embodiment shown, is parked overhanging the side edge 32 of the bag 21, although in other embodiments there may be no overhang. This results in advantages. The overlap of the end clip 56 by the slider device 50 increases the opening width of the mouth 22 beyond what is obtainable by a slider device that uses an end of the slider device abutting the end clip 56 as a stopping surface.

When the closure 26 is closed, the slider device 50 is positioned with an end face 70 against an end surface 72 of the clip 58.

Various embodiments of slider devices 50 can be used with the package 20 of FIGS. 1 and 2. A first embodiment of the slider device 50 is shown in FIG. 3. The slider device 50 includes a closing end 74 and an opposite opening end 76. The closing end 74 of the slider device 50 is the portion of the slider, which when being the trailing end while moving along the closure 26, will interlock the opposing tracks 38, 40. The opening end 76 is the portion of the slider device 50, which when trailing while moving along the closure 26, will unlock the interlocked tracks 38, 40 to open the mouth 22.

The slider device 50 includes a first end stop engagement surface 80 (FIGS. 10-18). The first end stop engagement surface 80 is positioned inboard, or away from, the closing end 74 and is adapted to strike the first end stop 56. In FIG. 3, a leg engagement surface 119 (described further below) is within a same plane as the first end stop engagement surface 80, and is located at a distance "d" from the closing end 74. Example useable distances d can be many distances and range from 0.1 inch-0.75 inch, and can be between 10-90% of an overall length of the slider device 50.

In general, a user wishing to open the zipper closure 26 moves the slider device 50 along the tracks 38, 40 in the opening direction 66 with the closing end 74 leading, and the opening end 76 trailing. This separates the interlocked tracks 38, 40 and opens the mouth 22. The movement in the opening direction 66 continues until the slider device 50 is stopped by engagement between the first end stop engagement surface 80 and surface 82 of the clip 56. In some non-limiting examples, the movement in the opening direction 66 continues past the side edge 32 of the bag 21. It should be noted in FIG. 2 that the respective end surfaces 72 of the clip 58 and end surface 82 of the clip 56 face each other and the zipper closure 26. Opposite end surfaces 84 for clip 58 and 86 for clip 56 face away from the remainder of the zipper closure 26, and in this embodiment, are shown to be even with, or very close to even with, the side edges 34, 32, but do not necessarily need to be.

When the end stop engagement surface 80 of the slider device 50 hits the end surface 82 of the clip 56, the slider device 50 is prevented from further motion in the opening direction 66, and the mouth 22 is open to allow access to the interior 24.

The slider device 50 usable with the zipper closure system of FIGS. 1 and 2 can have many embodiments. Reference is now made to FIGS. 3 and 12-18, which show various embodiments of slider devices 50 that are usable with the slider zipper closure system 64 of FIGS. 1 and 2.

The slider device 50 includes a top member 90. The top member 90 extends between the opening end 76 and the closing end 74. In the examples shown in FIGS. 3 and 10-18, the top member 90 is a solid wall 91. Although in the examples shown, the wall 91 is a flat, planar surface, there can be many variations including contours or handles or finger-grasp areas.

The top member 90 has an externally directed outer surface 92 and an opposite internal surface 94. The internal surface 94 faces the zipper closure 26, when the slider device 50 is slidably mounted on the zipper closure 26.

The slider device 50 includes a pair of spaced legs 96, 97. The legs 96, 97 depend from the top member 90. The spaced legs 96, 97 define an open volume 98 therebetween, to allow for passage of the tracks 38, 40 therethrough. The legs 96, 97 have terminal ends 101, 102 straddling the tracks 38, 40, when the slider device 50 is positioned on the zipper closure 26.

The internal surface 94 of the top member 90 is located within the open volume 98 between the legs 96, 97. As can be seen in the views of FIGS. 10-18, the internal surface 94 includes at least a first region 104 and a second region 106. The first region 104 extends from the closing end 74 partially along the internal surface 94 of the top member 90. The second region 106 is between the first region 104 and the opening end 76. The first region 104 extends at a greater distance from the terminal ends 101, 102 of the spaced legs 96, 97 than the second region 106. The resulting effect is that the volume 98 between the legs 96, 97 between the closing end 74 and where the first region 104 ends along the internal surface 94 creates a recess 108. The recess 108 forms a first overlap chamber 109 to allow the slider device 50 to straddle the end stop 52 and move beyond the plane of end surface 82; in some non-limiting examples, this is moving beyond the side edge 32 of the bag 21 in the open position. The first end stop engagement surface 80 in the recess 108 strikes the end surface 82 of the clip 56 of the end stop 52 and prevents the slider device 50 from coming off of the zipper closure 26.

In the example embodiments of FIGS. 3 and 10-18, the first end stop engagement surface 80 is part of the second region 106 of the top member 90. For example, as shown in the depicted embodiments, the first end stop engagement surface 80 is an end face 110 of the second region 106. The end face 110 is contained within a plane that is generally orthogonal to a plane containing the wall 91 of the top member 90.

The slider device 50 further includes internal surfaces 112, 113 within the legs 96, 97 that are spaced sufficiently close together to press the profiles 39, 41 into interlocking relationship, as the slider device 50 is moved in the closing direction 68 along the zipper closure 26 leading with the opening end 76 and trailing with the closing end 74.

The slider device 50 further includes a separator plow 114. The separator plow 114 extends from the second region 106 of the top member 90 into the open volume 98 between the legs 96, 97. The separator plow 114 is positioned to wedge between the opposing tracks 38, 40 and disengage the profiles 39, 41, as the slider device 50 is moved in the opening direction 66 along the zipper closure 26 leading with the closing end 74 and trailing with the opening end 76. Many different embodiments for the plow 114 are possible. In the example shown, the plow 114 has the shape of a triangle, with a base of the triangle being at or adjacent to the opening end 76, and an apex of the triangle pointing toward the closing end 74.

In the embodiments of FIGS. 10-18, the first end stop engaging surface 80 is located between the separator plow 114 and the first region 104. As will be described in connection with further embodiments (for example, FIG. 20) the first end stop engagement surface 80 can also be a portion of the separator plow 114.

In the embodiments of 10-18, the second region 106 extends from the opening end 76 of the slider device 50. In other embodiments (for example, FIG. 7), the second region 106 is spaced from the opening end 76.

In many embodiments, the internal surface 94, as extending between the closing end 74 and opening end 76, is not in a single plane. In some example embodiments, the internal surface 94 has at least two planes, and they can be parallel to each other. For example, the first region 104 is contained in a first plane, and the second region 106 is contained in a second plane parallel to the first plane, with the plow 114 extending from the second plane.

Each the legs 96, 97 can further include a leg engagement surface 118, 119. The leg engagement surface 118, 119 extends from an internal surface of each of the legs 96, 97 and can be a portion of the first end stop engagement surface 80. For example, in the embodiment of FIG. 10, it can be seen how the first end stop engagement surface 118, 119 extends orthogonally from the internal surface 94 of the top member 90 and is within the same plane as the first end stop engagement surface 80.

For the slider devices 50 shown in FIGS. 10-18, each of the legs 96, 97 has an internal facing hook 116, 117 at their respective terminal ends 101, 102. The hooks 116, 117 help to hold the slider device 50 in place on the zipper closure 26 by having the hooks 116, 117 engage under the profiles 39, 41. Many embodiments are possible.

For example, in the embodiment of FIGS. 10-13, the hooks 116, 117 extend an entire length of the slider device 50 between the opening end 76 and the closing end 74.

Figure 14:
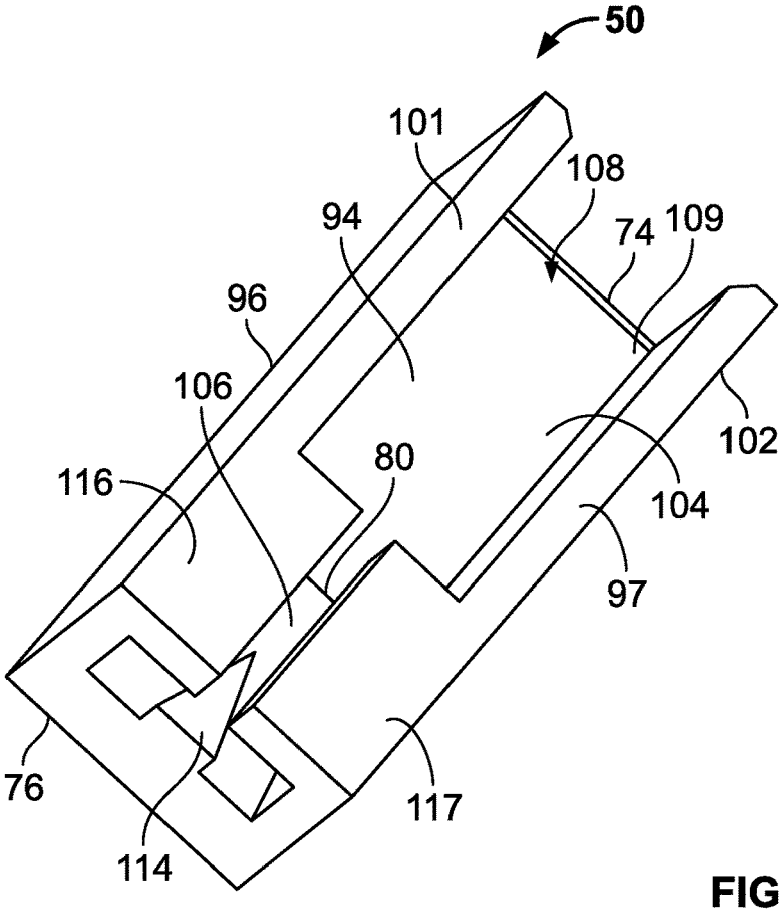
FIG. 14 is a perspective view of another slider device usable with the slider zipper closure system of FIGS. 1 and 2.
Figure 15:
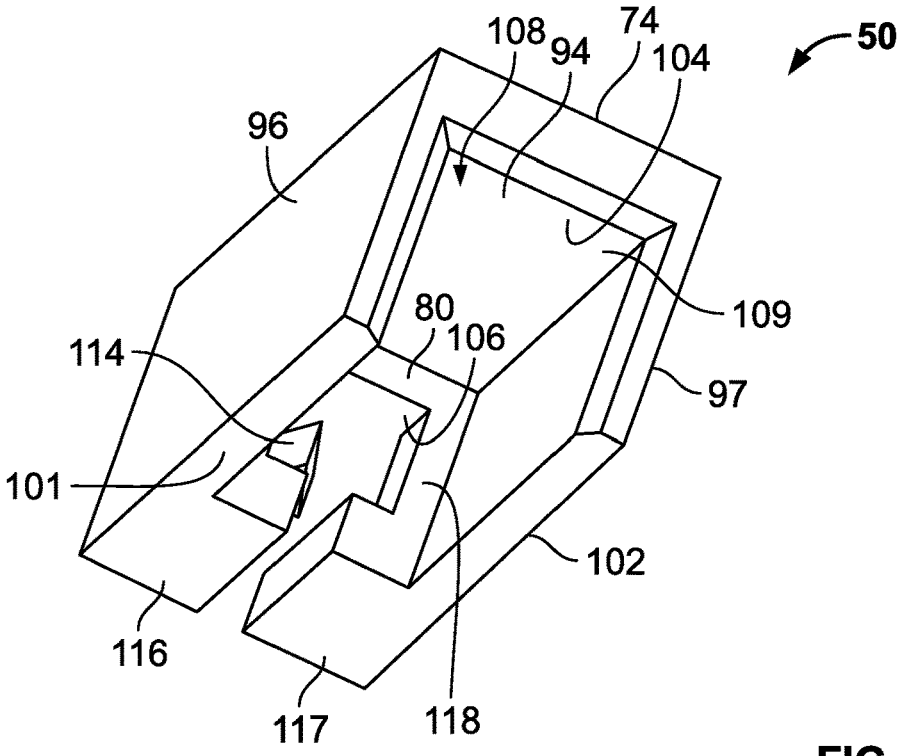
FIG. 15 is another perspective view of the slider device of FIG. 14.

In another example embodiment of FIGS. 14 and 15, the hooks 116, 117 extend only along the portions of the legs 96, 97 that extend from the opening end 76 to the engagement surface 80. In a non-limiting example, the hooks 116, 117 are along the second region 106 of the top member 90. As shown in FIGS. 14 and 15, the legs 96, 97 that are along the first region 104 do not have hooks.

Figure 16:
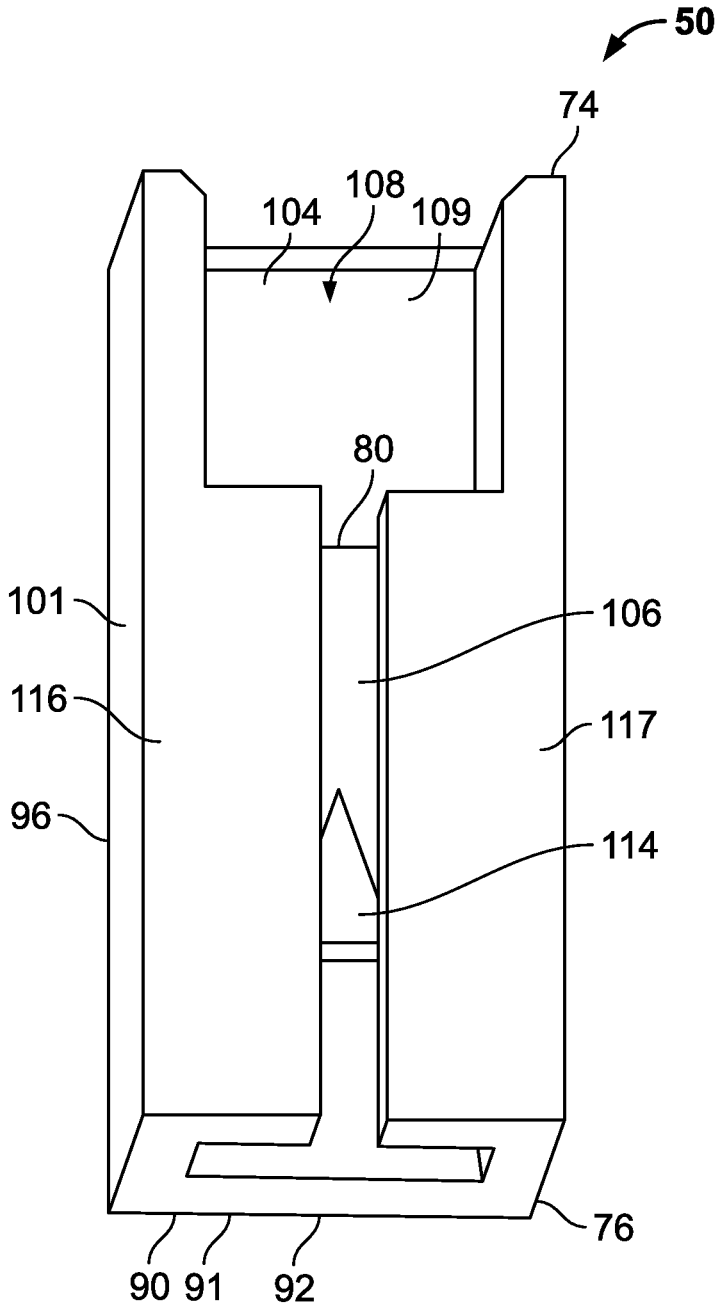
FIG. 16 is a perspective view of another embodiment of a slider device usable with the slider zipper closure system of FIGS. 1 and 2.
Figure 17:
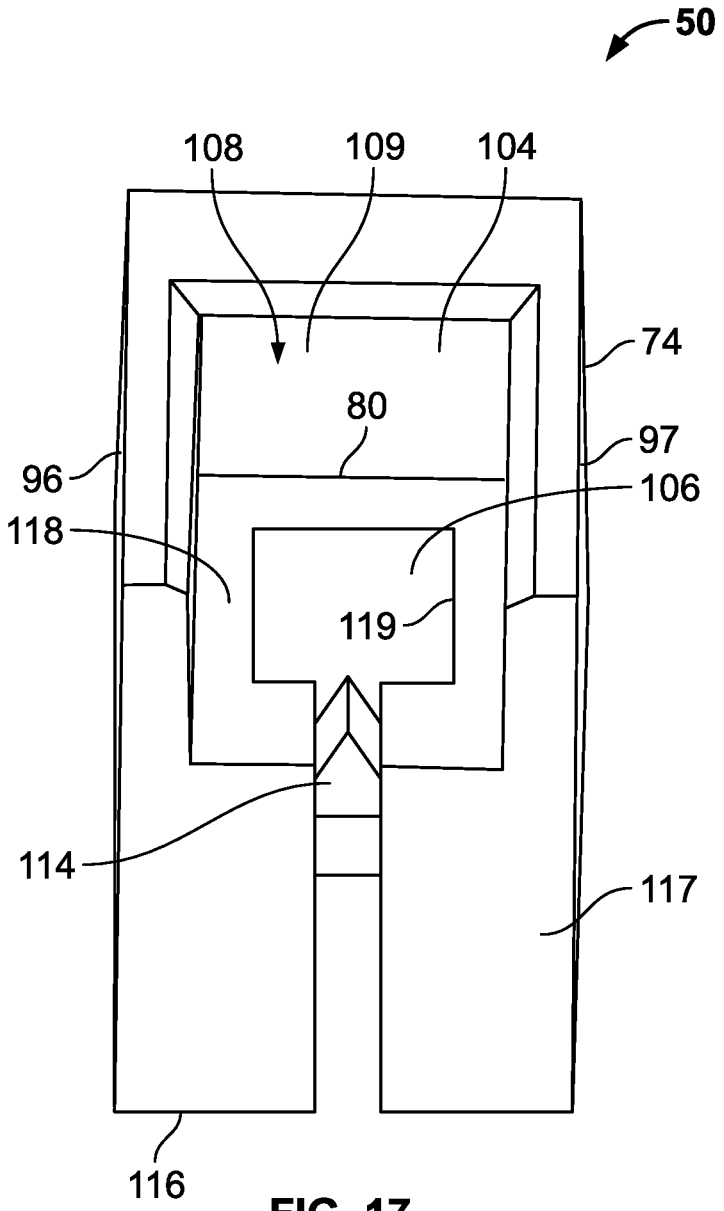
FIG. 17 is another perspective view of the slider device of FIG. 16.
Figure 18:
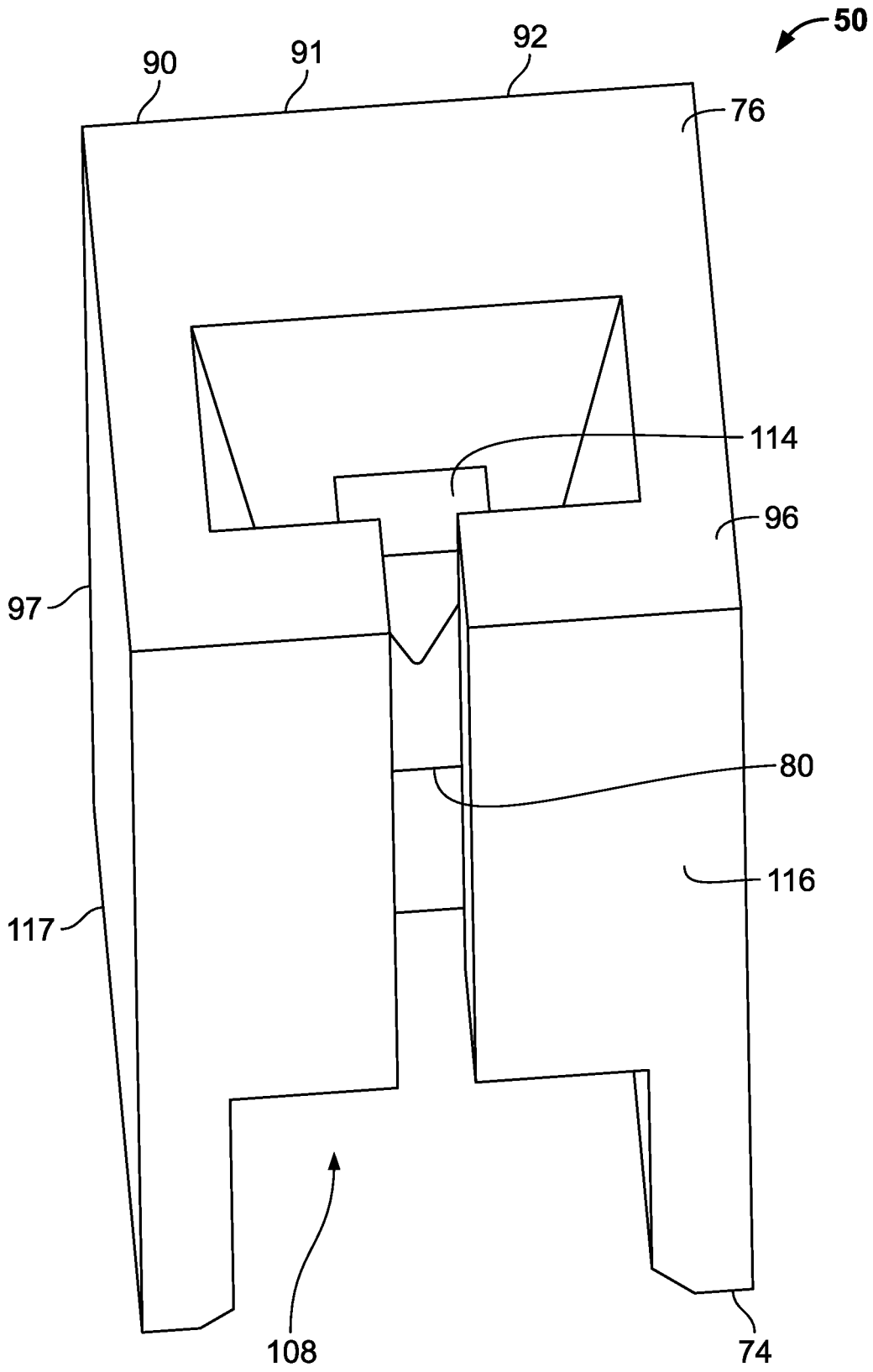
FIG. 18 is another perspective view of the slider device of FIG. 16.

In the embodiment of FIGS. 16-18, the hooks 116, 117 extend from the opening end 76 only a partial length of the slider device 50 toward the closing end 76. This embodiment is similar to that shown in FIGS. 14 and 15, in that the hooks 116, 117 extend from the opening end 76 only along portions of the legs 96, 97 that are along the second region 106 of the top member 90. However, in the embodiment of FIGS. 16-18, the length of the second region 106 is longer than the length of region 104. Compare this to the embodiment of FIGS. 14 and 15, in which the length of the second region 106 is shorter than the length of the first region 104. As such, in the embodiment of FIGS. 14 and 15, the recess 108 is greater, resulting in a longer (or deeper) first overlap chamber 109. This results in allowing the slider device 50 to move further in the opening direction 66 and create a greater opening in the mouth 22.

C. The Embodiments of FIGS. 4-9 and 20

In the embodiment of FIGS. 4 and 5, the package 20 includes slider zipper closure system 64. The slider zipper closure system 64 is the same as the system previously described with respect to FIGS. 1 and 2, but in this case, the end stops 52, 54 are formed fins 60 (shown in hidden lines in FIG. 4), 62, instead of clips 56, 58. The formed fins 60 can be made by, for example, ultrasonically forming. The slider device 50 also has different internal structure, as described further below. General operation of the slider zipper closure system 64 of FIGS. 4 and 5 is the same, in that when the slider device 50 is moved in the opening direction 66, the complementary profiles 39, 41 are disengaged or unlocked to provide access to the interior 24 of the bag 21 through the mouth 22. When the slider device 50 is moved in the closing direction 68, the complementary profiles 39, 41 are interlocked to close the mouth 22 and contain the contents in the interior 24.

Figure 6:
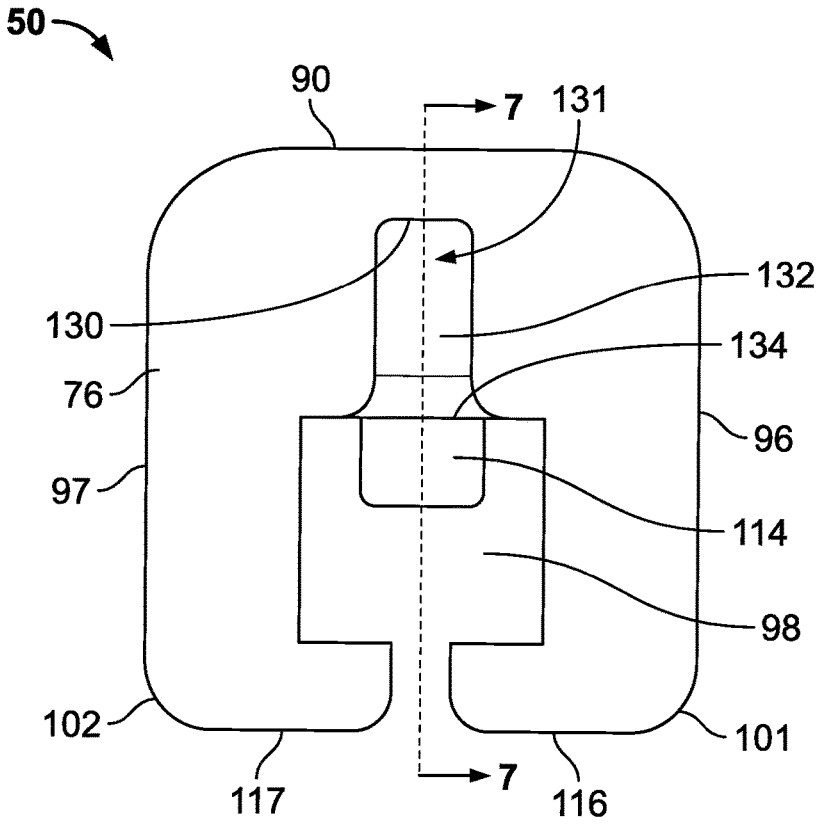
FIG. 6 is an end view of the slider device used in FIGS. 4 and 5.
Figure 7:
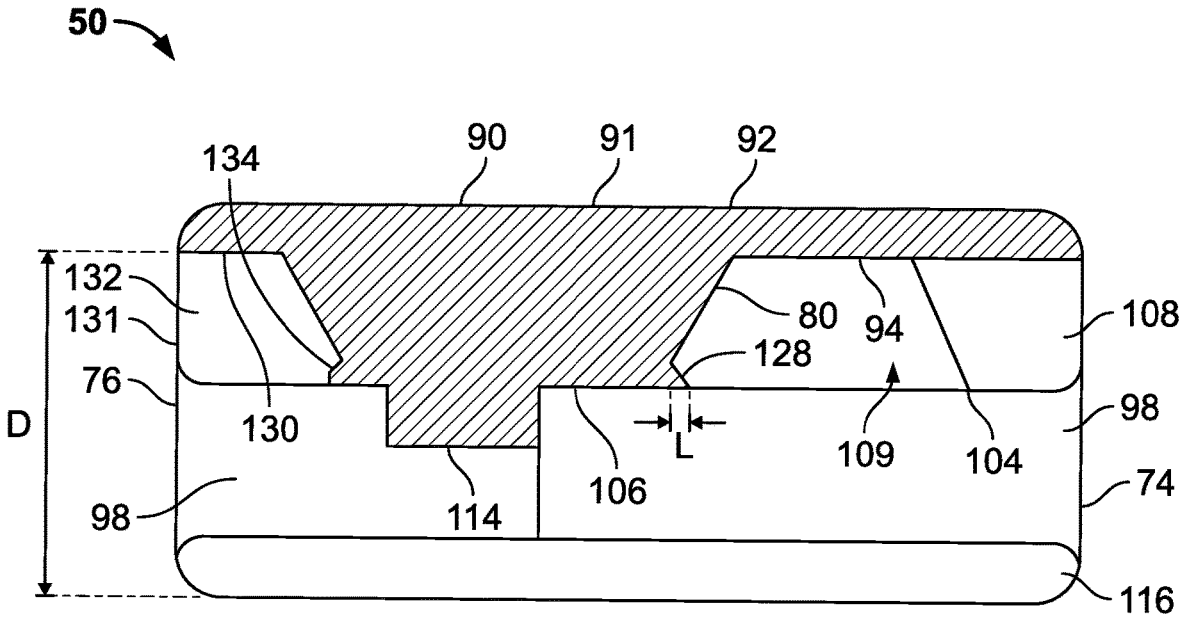
FIG. 7 is a cross-sectional view of the slider device of FIG. 6, the cross section being taken along the line A-A of FIG. 6.
Figure 8:
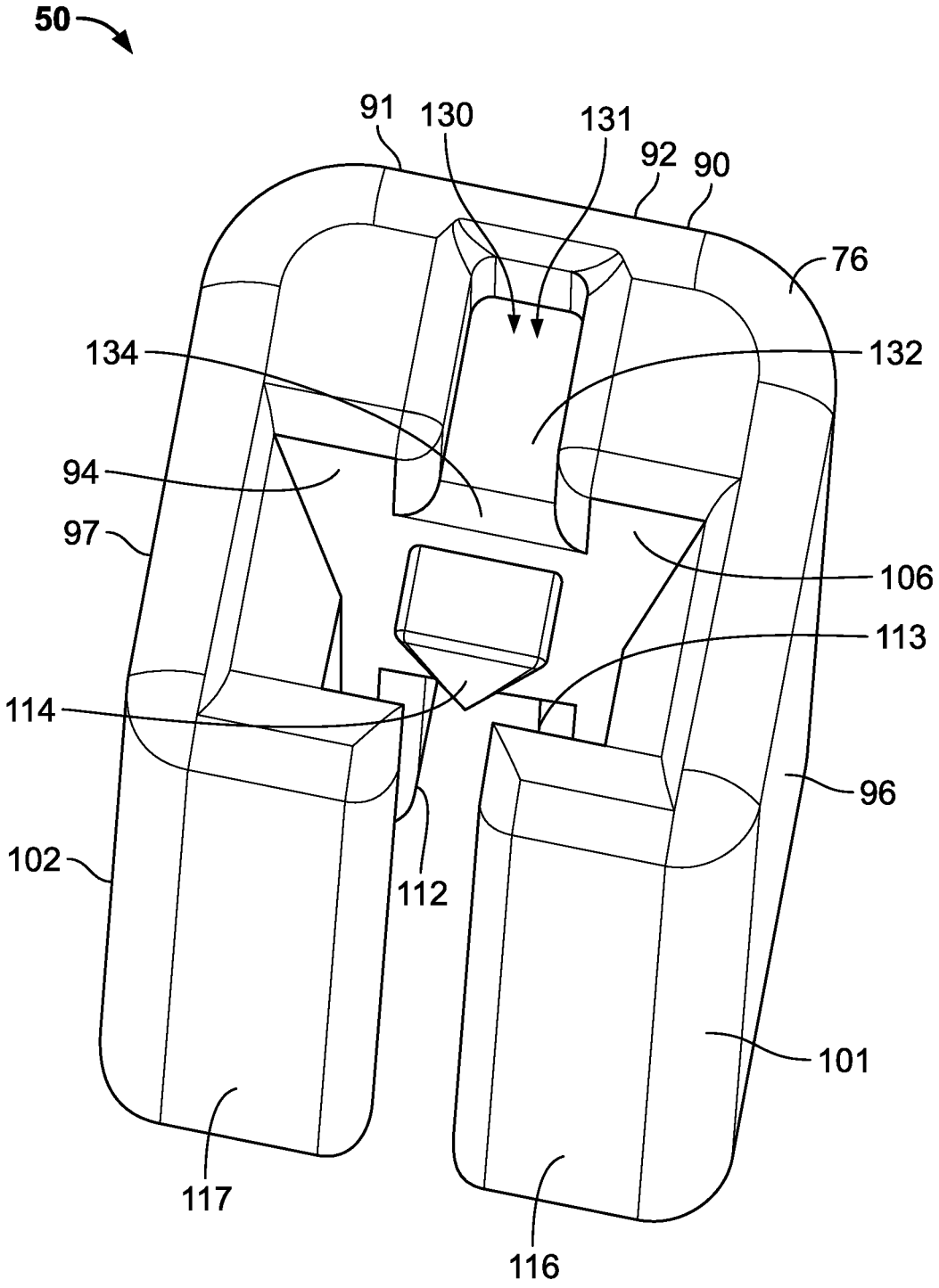
FIG. 8 is a perspective view of the slider device of FIGS. 6 and 7.

One example embodiment of slider device 50 usable with the closure system 64 of FIGS. 4 and 5 is shown in FIGS. 6-8. FIGS. 6 and 8 are an end view of the slider device 50, as viewed from the opening end 76. FIG. 7 is a cross-sectional view of the slider device 50, taken along the line A-A of FIG. 6.

In FIG. 7, the slider device 50 illustrates the first region 104 extending from the closing end 74 partially along the internal surface 94 of the top member 90. The second region 106 having the first end stop engagement surface 80 is also visible. In this embodiment, the slider device 50 includes a first pointed projection 128 extending from the first end stop engagement surface 80 partially toward the closing end 74. The pointed projection 128 is sized and shaped to dig into the ultrasonic fin 60 of the first end stop 52. The dimensions of the pointed projection 128 can be adjusted, per the needs of the closure 26. In general, the pointed projection 128 is sharp, but not so long or deep that it would cut off the ultrasonically formed fin 60. The pointed projection 128 is long enough to dig in, but the slider device 50 will jam up against the ultrasonic fin 60, once the pointed projection 128 begins cutting in. In some example embodiments, the length of the pointed projection shown at extension L in FIG. 7 is at least 0.01 inch and no greater than 0.1 inch.

Still in reference to FIGS. 6-8, the slider device 50 further includes a third region 130 that is part of the internal surface 94 of the top member 90. The third region 130 extends from the opening end 76, with the second region 106 being between the third region 130 and the first region 104. As can be seen in FIG. 7, the third region 130 extends at a greater distance from the terminal ends 101, 102 of the legs 96, 97 than the second region 106. This defines a recess 131 defining a second overlap chamber 132 at the opening end 76.

While many different embodiments are possible, in the one shown, the third region 130 and the first region 104 extend at a same distance "D" (FIG. 7) from the terminal ends 101, 102 of the legs 96, 97. The second overlap chamber 132 allows the slider device 50 to capture the ultrasonic fin 62. The second overlap chamber 132 also helps to prevent the fin 62 from being pushed out of the way when the slider device 50 is positioned in the closed position on the zipper closure 26.

In many embodiments, the internal surface 94, as extending between the closing end 74 and opening end 76, is in two or more planes, which can be parallel to each other. For example, the first region 104 is contained in a first plane, and the second region 106 is contained in a second plane parallel to the first plane, with the plow 114 extending from the second plane, and the third region 130 is contained in either the first plane or in a third plane.

With reference again to FIG. 7, the slider device 50 can further include a second pointed projection 134 extending from the second region 106 partially toward the opening end 76. The second pointed projection 134 is sized to dig into the ultrasonic fin 134, but it is sized such that it is not long or deep enough to cut off the ultrasonically formed fin 62. The second pointed projection 134 can be sized with about the same dimensions as the first pointed projection 128. As can be seen in FIG. 7, the second pointed projection 134 points toward the opening end 76 and into the second overlap chamber 132.

In FIG. 9, the slider zipper closure system 64 is illustrated with the slider device 50 removed for a better illustration of the end stops 52, 54. The ultrasonic fins 60, 62 are shown along with indents 136, 137. The indents 136, 137 are created after the slider device 50 has been pushed against the end stops 52, 54 and the pointed projections 128, 134 have dug into the fins 60, 62. The indent 137 is shown enlarged, and has the same appearance as the indent 136. As can be seen from reviewing FIG. 9, the indents 136, 137 are small relative to the overall length of the base of the fins 60, 62. For example, the indents 136, 137 extend less than 0.01 inch into the respective fins 60, 62. As a percent of the overall length of the base of the fins 60, 62, the length of the indents 136, 137 is no greater than 30%.

Figure 20:
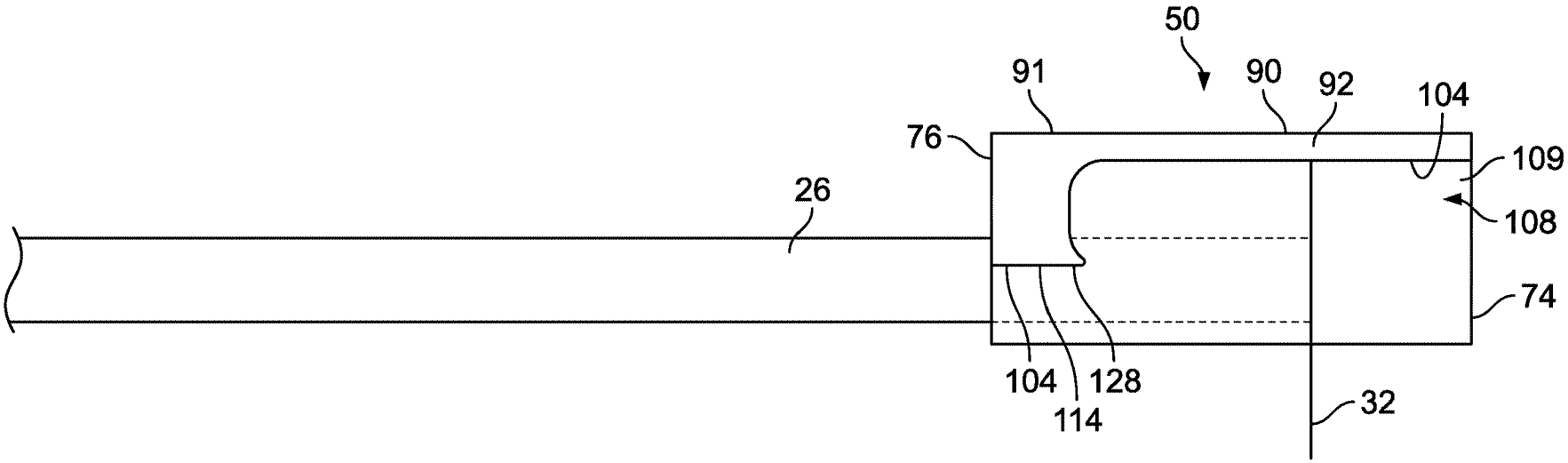
FIG. 20 is a schematic view of a variation of the slider device of FIGS. 6-8, used with the slider zipper closure system of FIGS. 4 and 5.

FIG. 20 is a variation on the slider device 50 shown in FIGS. 6-8. In FIG. 20, the slider device 50 is shown schematically in cross-section engaging the fin 60, which is omitted for clarity. In this embodiment, the first end stop engagement surface 80 is a portion of the separator plow 114. The plow 114 includes the first pointed projection 128 extending from the apex of the plow 114. The second region 104 extends from the opening end 76 to the end of the plow 114 at the first pointed projection 128. The first region 104 extends from the closing end 74 completely to the pointed projection 128 of the plow 114.

In operation, the system 64 of FIGS. 4 and 5 can be used by opening the mouth 22 by moving the slider device 50 in the opening direction 66, which separates the profiles 39, 41. The movement of the slider device in the opening direction 66 continues and overlaps the start of the end stop 52, which in some non-limiting examples can include moving past the side edge 32 of the bag 21, until the slider device 50 is stopped by the first pointed projection 128 hitting or engaging the ultrasonic fin 60. The first pointed projection 128 rides just above the tracks 38, 40 prior to contact with the ultrasonic fin 60. After the closure 26 is opened, the contents of the package 20 can be accessed. Thereafter, the slider device 50 is moved in the closing direction 68 to engage the profiles 39, 41 and close the mouth 22. The overlap feature 132 will receive the fin 62, and the second pointed projection 134 will dig into the fin 62.

D. Example Methods of Use

The above structures can be used as part of a method of operating a zippered flexible package having an openable and reclosable mouth. In one example, the method includes providing a zippered package 20, such as bag 21 having surrounding wall 36 formed from first and second panels 28, 30 each having a top forming the mouth 22. The surrounding wall 37 has closed bottom 36 at an end that is opposite of the mouth 22 and side edges 32, 34 along opposite sides. Reclosable zipper closure 26 includes opposing tracks 38, 40 with complementary profiles 39, 41 for interlocking and unlocking. One profile 39 is in proximity to the top of the first panel 28, while the other profile 41 is in proximity to the top of the panel 30. The complementary profiles 39, 41 interlock to close the mouth 22 and unlock to open the mouth 22. First and second end stops 52, 54 are on opposite ends of the zipper closure 26. Slider device 50 is slidably or operable mounted on the zipper closure 26. The slider device 50 has a closing end 74 and an opposite opening end 76. The slider device 50 also has a first end stop engagement surface 80 positioned inboard from the closing end 74. The method includes opening the mouth 22 by moving the slider device 50 along the tracks 38, 40 leading with the closing end 74 and trailing with the opening end 76 to unlock the complementary profiles 39, 41 until the first end stop engagement surface 80 strikes the first end stop 52.

In one example method, the step of striking the first end stop 52 includes striking inverted U-clip 56 forming the first ends stop 52.

In another variation, the step of striking the first end stop 52 includes digging first pointed projection 128 extending from the first end stop engagement surface 80 partially toward the closing end 74 into ultrasonically formed fin 60 forming the first end stop 52.

The method can further include the step of closing the mouth 22. The step of closing the mouth 22 includes moving the slider device 50 along the tracks 38, 40 leading with the opening end 76 and trailing with the closing end 74 to interlock the complementary profiles 39, 41 until the opening end 76 strikes inverted U-clip 58 forming the second end stop 54.

In another variation, the step of closing the mouth 22 includes moving the slider device 50 along the tracks leading with the opening end 76 and trailing with the closing end 74 to interlock the complementary profiles 39, 41 until the second pointed projection 134 positioned in board from the opening end 76 digs into the ultrasonic fin 62 forming the second end stop 54.

E. Additional Comments/Observations

A variety of embodiments for the slider device 50 are usable, and the relative dimensions of the various features can be modified, per the system requirements. For example, the length of the recess 108 can vary from the closing end 74 until the plow 114 becomes a first end stop engagement surface 80, as shown in FIG. 20. The dimensions of the plow 114 and the length of the recess 108 can be related in that the length of the plow 114 added to the length of the recess 108 can equal the total length of the slider device 50, assuming that the plow 114 is located at the opening end 76 of the slider device 50. The dimensions of the plow 114 are driven by the geometry required to open and close a specific zipper closure 26, and the recess 108 dimensions are driven by the dimensions of the plow 114.

The overlap chambers 109, 132 can be helpful in increasing usable opening of the package and/or improving end retention by helping to capture the end stop. When the slider device 50 includes second overlap chamber 132 on the opening end 76 of the slider device 50, the purpose is to improve retention of the end stop 54. When the chamber 109 is on the closing end 74, it has a dual purpose of increasing the size of the opening of the mouth 22 and of improving retention of the end stop 52.

Some helpful dimensions to the overlap chamber 109 include the overlap length (the length from end of slider device 50 to where the overlap stops); overlap width 111 (FIG. 10); and overlap height (from internal surface 94 of top member 90 to terminal ends 101, 102).

(1) Overlap length: the length of the overlap chamber 109, 132 depends on the purpose of the overlap, the size of the slider 50, and the dimensions of the end stop 52, 54 with which it is intended to interact. If the purpose of the overlap chamber 109, 132 is only for end retention, it need only be deep enough to capture the fin 60, 62, such that when a force is applied the fin 60, 62 is not allowed to fold under or out of the way of the slider 50 and allow the slider 50 to become free of the closure 26. If the purpose of the overlap chamber 109 is to maximize usable opening space, the overlap chamber 109 should be as long as possible. Constraints that might limit the length include the overall length of the slider 50, location of the plow 114 within the slider 50, and the distance from the contact point of the end stop 52, 54 to the edge 32, 34 of the closure 26, if desirable for the slider 50 not to exceed the edge of the closure 26.

(2) Overlap width: the width 111 of the overlap chamber 109, 132 depends to some degree on the purpose. If the purpose is end retention, it may be desirable for the overlap chamber 109, 132 to be relatively narrow, close to the width of the fin 60, 62. If the purpose of the overlap chamber 109 is to increase usable opening space, it may be desirable to provide plenty of clearance to make sure the slider 50 can easily overlap the end stop 52, 54. A dimension of 0.010" to 0.020" clearance vs. the target width of the slider 50 is sufficient in most cases.

(3) Overlap height: The height of the overlap chamber 109, 132 is basically a one-side specification, it needs to be tall enough to provide clearance over the end stop 52, 54. There is a trade-off between the amount of clearance provided and the height of the slider 50. The taller the overlap chamber 109, 132, the less risk there is for interference between the top of the chamber 109, 132 and the end stop 52, 54, but the taller the overall slider 50 will have to be, which may be undesirable in terms of cost, packaging, customer preference, etc. In some embodiments, the overlap chamber 109, 132 can extends through the top of the slider 50 making it more of a slot than a chamber.

Side-to-side location: It is possible that the end stop 52, 54 could be offset to one side of the track. In this case, the overlap chamber 109, 132 may also need to be offset. The overlap chamber 109, 132 should be located according to the target end stop 52, 54 location across the width of track profile.

Other factors: The pointed projections 128, 134 should be sharp enough to cut into the fins 60, 62. The length of the projections cannot be too short or too long. If too short, it may not develop enough interference to increase end retention significantly—it could slip out of the indents 136, 137 it makes in the end stop 52, 54 too easily, or it could fail to form any indents at all. If too long, there is a risk that the projections 128, 134 could cut so far into the end stop 52, 54 that it would be weakened, or even continue to cut all the way through the end stop 52, 54 and off the closure 26.

It is desirable for the width of the pointed projections 128, 134 to be at least as wide as the end stop 52, 54, and lined up with the end stop 52, 54. If the pointed projections 128, 134 are too narrow, non-cutting surfaces of the slider 50 may contact the end stop 52, 54 first and not dig in. This risk is higher given that there can be some uncertainty in the location and thickness of the end stop 52, 54 due to manufacturing process variation. The pointed projections 128, 134 are inside of an overlap chamber 109, 132 and should be across the full width of the overall chamber 109, 132. The width of the overlap chamber 109, 132 is driven by other factors unrelated to the pointed projections 128, 134.

The pointed projections 128, 134 can ride right on the top of the tracks 38, 40, or can be elevated off of the tracks 38, 40 some amount. The pointed projections 128, 134 can be elevated off of the track to "almost" the height of the end stop 52, 54 and still be effective at improving end retention. If the pointed projections 128, 134 are above the height of the top of the end stop 52, 54, it would be rendered ineffective. It is most effective when closer to the top of the tracks 38, 40 (effectively the bottom of the fins 60, 62), where the fins 60, 62 are thick, thus providing more material to create force and making it less likely that the fin 60, 62 may bend out of the way when the pointed projections 128, 134 is not paired with an overlap chamber 109, 132; or, they are relatively shallow due to other constraints.

Some useful dimensions include:

The pointed projections 128, 134 formed by a 60 degree angle, where a bottom leg of the projections is parallel with the tracks 38, 40, and a top leg extends away from the top of the slider 50. Different angles could be used. Also, the legs do not necessarily need to be straight; curved surfaces could be used if there was a need.

If made within a mold, depending on the construction of the mold tool, the pointed projections 128, 134 can be a "sharp" corner—formed by two different halves of a mold, or have a radius of 0.003 to 0.005".

A blunt surface behind the pointed projections 128, 134 is about 0.015" behind the projections 128, 134. This distance could be changed based on the geometry of end stops 52, 54, track material, sharpness, end stop 52, 54. The blunt surface could be a straight wall or any other contoured surface depending on need.

If there is no overlap chamber 109, 132, the pointed projections 128, 134 can be about 0.020" wider than the target width of the end stop 52, 54. If there is an overlap chamber 109, 132, the pointed projections 128, 134 can extend the full width inside the overlap chamber 109, 132, but in other embodiments do not do so.

Preferably, the pointed projections 128, 134 will ride just above the tracks 38, 40.

The above disclosure represents example principles. Many embodiments can be made applying these principles.

What is claimed is:

1. A slider device for selectively interlocking and unlocking complementary profiles of opposing tracks of a plastic zipper closure; the slider device comprising:

(a) a top member with an opening end and an opposite closing end;

(b) pair of spaced legs depending from the top member; the spaced legs defining an open volume therebetween to allow for passage of the tracks therethrough and with the legs having terminal ends straddling the tracks;

(c) the top member having an internal surface within the open volume between the legs; the internal surface including at least a first region and a second region;

(i) the first region extending from the closing end partially along the internal surface of the top member; and (ii) the second region being between the first region and the opening end;

(iii) the first region being located a greater distance from the terminal ends of the spaced legs than the second region;

(d) internal surfaces spaced sufficiently close together to press the profiles into interlocking relationship as the slider is moved in a closing direction along the zipper closure leading with the opening end and trailing with the closing end;

(e) a separator plow extending from the second region of the top member into the open volume between the legs; the separator plow being positioned to wedge between opposing tracks and unlock the profiles as the slider device is moved in an opening direction along the zipper closure leading with the closing end and trailing with the opening end; and (f) the second region of the top member including an engagement surface positioned to strike an end stop on at least one end of the zipper closure.

2. The slider device of claim 1 wherein the engagement surface is located between the separator plow and the first region.

3. The slider device of claim 1 wherein the legs each having internal facing hooks at their respective terminal ends.

4. The slider device of claim 2 wherein the engagement surface is a portion of the separator plow.

5. The slider device of claim 1 further including a leg engagement surface extending from an internal surface of each of the legs.

6. The slider device of claim 3 wherein the hooks extend from the opening end only a partial length of the slider device toward the closing end.

7. The slider device of claim 6 wherein the hooks extend only along the portions of the legs that are along the second region of the top member.

8. The slider device of claim 1 wherein the second region extends from the opening end.

9. The slider device of claim 2 further including a first pointed projection extending from the engagement surface partially toward the closing end.

10. A slider device for selectively interlocking and unlocking complementary profiles of opposing tracks of a plastic zipper closure; the slider device comprising:

(a) a top member with an opening end and an opposite closing end;

(b) pair of spaced legs depending from the top member; the spaced legs defining an open volume therebetween to allow for passage of the tracks therethrough and with the legs having terminal ends straddling the tracks;

(c) the top member having an internal surface within the open volume between the legs; the internal surface including at least a first region and a second region;

(i) the first region extending from the closing end partially along the internal surface of the top member; and (ii) the second region being between the first region and the opening end;

(iii) the first region being located at a greater distance from the terminal ends of the spaced legs than the second region;

(d) internal surfaces spaced sufficiently close together to press the profiles into interlocking relationship as the slider is moved in a closing direction along the zipper closure leading with the opening end and trailing with the closing end;

(e) a separator plow extending from the second region of the top member into the open volume between the legs; the separator plow being positioned to wedge between opposing tracks and unlock the profiles as the slider device is moved in an opening direction along the zipper closure leading with the closing end and trailing with the opening end;

(f) the second region of the top member including an engagement surface positioned to strike an end stop on at least one end of the zipper closure; and (g) a first pointed projection extending from the engagement surface partially toward the closing end.

11. The slider device of claim 10 wherein:

(a) the internal surface of the top member further includes a third region;

(b) the third region extending from the opening end, with the second region being between the third region and the first region;

(c) the third region extending at a greater distance from the terminal ends of the spaced legs than the second region.

12. The slider device of claim 11 wherein the third region and the first region extend a same distance from the terminal ends of the spaced legs.

13. The slider device of claim 11 wherein the third region and the first region extend a different distance from the terminal ends of the spaced legs.

14. The slider device of claim 11 further including a second pointed projection extending from the second region partially toward the opening end.

15. A slider zipper closure system comprising:

(a) a recloseable zipper closure with complementary profiles of opposing tracks for interlocking and unlocking; the closure having a first end and an opposite second end;

(b) a first end stop positioned at the first end of the closure;

(c) a second end stop positioned at the second end of the closure; and (d) a slider device having a closing end and an opposite opening end; the slider device slidably positioned on the zipper closure between and engaging the first end stop and second end stop to selectively:

(i) unlock the complementary profiles as the slider device is moved along the tracks in an opening direction leading with the closing end and trailing with the opening end; and (ii) interlock the complementary profiles as the slider device is moved along the tracks in a closing direction leading with the opening end and trailing with the closing end;

(e) the slider device having a first end stop engagement surface positioned inboard from the closing end and adapted to strike the first end stop;

(f) the slider device having, (i) a top member;

(ii) pair of spaced legs depending from the top member; the spaced legs defining an open volume therebetween with passage of the tracks therethrough and with the legs having terminal ends straddling the tracks;

(iii) the top member having an internal surface within the open volume between the legs; the internal surface including at least a first region and a second region;

(i) the first region extending from the closing end a partially along the internal surface of the top member; and (ii) the second region being between the first region and the opening end;

(iii) the first region being located at a greater distance from the terminal ends of the spaced legs than the second region;

(iv) internal surfaces spaced sufficiently close together to press the profiles into interlocking relationship as the slider is moved in the closing direction;

(v) a separator plow extending from the second region of the top member into the open volume between the legs; the separator plow adapted to wedge between opposing tracks and unlock the profiles as the slider device is moved in the opening direction along the zipper closure leading with the closing end and trailing with the opening end; and (vi) the second region of the top member including the first end stop engagement surface positioned to strike the first end stop, when the zipper closure has been unlocked;

wherein the first end stop and the second end stop are each an inverted U-clip; and wherein the first end stop engagement surface is a portion of the separator plow.

16. The slider zipper closure system of claim 15 wherein the opening end of the slider device engages against the second end stop, when the zipper closure has been interlocked.

17. A slider zipper closure system comprising:

(a) a recloseable zipper closure with complementary profiles of opposing tracks for interlocking and unlocking; the closure having a first end and an opposite second end;

(b) a first end stop positioned at the first end of the closure;

(c) a second end stop positioned at the second end of the closure; and (d) a slider device having a closing end and an opposite opening end; the slider device slidably positioned on the zipper closure between and engaging the first end stop and second end stop to selectively:

(i) unlock the complementary profiles as the slider device is moved along the tracks in an opening direction leading with the closing end and trailing with the opening end; and (ii) interlock the complementary profiles as the slider device is moved along the tracks in a closing direction leading with the opening end and trailing with the closing end;

(e) the slider device having a first end stop engagement surface positioned inboard from the closing end and adapted to strike the first end stop;

(f) the slider device having, (i) a top member;

(ii) pair of spaced legs depending from the top member; the spaced legs defining an open volume therebetween with passage of the tracks therethrough and with the legs having terminal ends straddling the tracks;

(iii) the top member having an internal surface within the open volume between the legs; the internal surface including at least a first region and a second region;

(i) the first region extending from the closing end a partially along the internal surface of the top member; and (ii) the second region being between the first region and the opening end;

(iii) the first region being located at a greater distance from the terminal ends of the spaced legs than the second region;

(iv) internal surfaces spaced sufficiently close together to press the profiles into interlocking relationship as the slider is moved in the closing direction;

(v) a separator plow extending from the second region of the top member into the open volume between the legs; the separator plow adapted to wedge between opposing tracks and unlock the profiles as the slider device is moved in the opening direction along the zipper closure leading with the closing end and trailing with the opening end; and (vi) the second region of the top member including the first end stop engagement surface positioned to strike the first end stop, when the zipper closure has been unlocked;

wherein the first end stop and second end stop are each ultrasonic fins projecting above a top of the tracks.

18. The slider zipper closure system of claim 17 wherein the slider device further includes a first pointed projection extending from the first end stop engagement surface partially toward the closing end and digging into the first end stop.

19. The slider zipper closure system of claim 18 wherein:

(a) the internal surface of the top member further includes a third region;

(b) the third region extends from the opening end, with the second region being between the third region and the first region; and (c) the third region extends at a greater distance from the terminal ends of the spaced legs than the second region.

20. The slider zipper closure system of claim 19, wherein the third region and the first region extend a same distance from the terminal ends of the spaced legs.

21. The slider zipper closure system of claim 19, wherein the third region and the first region extend a different distance from the terminal ends of the spaced legs.

22. The slider zipper closure system of claim 19, further including a second pointed projection extending from the second region partially toward the opening end and digging into the second end stop.

23. A method operating a zippered flexible package having an openable and recloseable mouth; the method comprising:

(a) providing a zippered flexible package having a recloseable zipper closure at the mouth including opposing tracks with complementary profiles for interlocking and unlocking; the complementary profiles interlocking to close the mouth and unlocking to open the mouth; first and second end stops on opposite ends of the zipper closure; a slider device located on the zipper closure; the slider device having a closing end and an opposite opening end and a first end stop engagement surface positioned inboard from the closing end;

(b) opening the mouth by moving the slider device along the tracks leading with the closing end and trailing with the opening end to unlock the complementary profiles until the first end stop engagement surface strikes the first end stop; and (c) wherein the step of striking the first end stop includes digging a first pointed projection extending from the first end stop engagement surface partially toward the closing end into an ultrasonically formed fin forming the first end stop.

24. The method of claim 23 wherein the step of striking the first end stop includes striking an inverted U-clip forming the first end stop.

25. The method of claim 24 further including closing the mouth by moving the slider device along the tracks leading with the opening end and trailing with the closing end to interlock the complementary profiles until the opening end of the slider device strikes an inverted U-clip forming the second end stop.

26. The method of claim 23 further including closing the mouth by moving the slider device along the tracks leading with the opening end and trailing with the closing end to interlock the complementary profiles until a second pointed projection positioned inboard from the opening end digs into an ultrasonically formed fin forming the second end stop.

27. A slider device for selectively interlocking and unlocking complementary profiles of opposing tracks of a plastic zipper closure; the slider device comprising:

(a) a top member with an opening end and an opposite closing end;

(b) pair of spaced legs depending from the top member; the spaced legs defining an open volume therebetween to allow for passage of the tracks therethrough and with the legs having terminal ends straddling the tracks;

(c) the top member having an internal surface within the open volume between the legs; the internal surface including at least a first region and a second region;

(i) the first region extending from the closing end partially along the internal surface of the top member; and (ii) the second region being between the first region and the opening end;

(iii) the first region being located at a greater distance from the terminal ends of the spaced legs than the second region;

(d) internal surfaces spaced sufficiently close together to press the profiles into interlocking relationship as the slider is moved in a closing direction along the zipper closure leading with the opening end and trailing with the closing end;

(e) a separator plow extending from the second region of the top member into the open volume between the legs; the separator plow being positioned to wedge between opposing tracks and unlock the profiles as the slider device is moved in an opening direction along the zipper closure leading with the closing end and trailing with the opening end; and (f) the second region of the top member including an engagement surface positioned to strike an end stop on at least one end of the zipper closure;

wherein the legs each has internal facing hooks at their respective terminal ends; and wherein the hooks extend an entire length of the slider device between the opening end and closing end.

28. A slider device for selectively interlocking and unlocking complementary profiles of opposing tracks of a plastic zipper closure; the slider device comprising:

(a) a top member with an opening end and an opposite closing end;

(b) pair of spaced legs depending from the top member; the spaced legs defining an open volume therebetween to allow for passage of the tracks therethrough and with the legs having terminal ends straddling the tracks;

(c) the top member having an internal surface within the open volume between the legs; the internal surface including at least a first region and a second region;

(i) the first region extending from the closing end partially along the internal surface of the top member; and (ii) the second region being between the first region and the opening end;

(iii) the first region being located at a greater distance from the terminal ends of the spaced legs than the second region;

(d) internal surfaces spaced sufficiently close together to press the profiles into interlocking relationship as the slider is moved in a closing direction along the zipper closure leading with the opening end and trailing with the closing end;

(e) a separator plow extending from the second region of the top member into the open volume between the legs; the separator plow being positioned to wedge between opposing tracks and unlock the profiles as the slider device is moved in an opening direction along the zipper closure leading with the closing end and trailing with the opening end; and (f) the second region of the top member including an engagement surface positioned to strike an end stop on at least one end of the zipper closure;

wherein the engagement surface is a portion of the separator plow.

29. A slider zipper closure system comprising:

(a) a recloseable zipper closure with complementary profiles of opposing tracks for interlocking and unlocking; the closure having a first end and an opposite second end;

(b) a first end stop positioned at the first end of the closure;

(c) a second end stop positioned at the second end of the closure; and (d) a slider device having a closing end and an opposite opening end; the slider device slidably positioned on the zipper closure between and engaging the first end stop and second end stop to selectively:

(i) unlock the complementary profiles as the slider device is moved along the tracks in an opening direction leading with the closing end and trailing with the opening end; and (ii) interlock the complementary profiles as the slider device is moved along the tracks in a closing direction leading with the opening end and trailing with the closing end;

(e) the slider device having a first end stop engagement surface positioned inboard from the closing end and adapted to strike the first end stop;

(f) the slider device having, (i) a top member;

(ii) pair of spaced legs depending from the top member; the spaced legs defining an open volume therebetween with passage of the tracks therethrough and with the legs having terminal ends straddling the tracks;

(iii) the top member having an internal surface within the open volume between the legs; the internal surface including at least a first region and a second region;

(i) the first region extending from the closing end a partially along the internal surface of the top member; and (ii) the second region being between the first region and the opening end;

(iii) the first region being located at a greater distance from the terminal ends of the spaced legs than the second region;

(iv) internal surfaces spaced sufficiently close together to press the profiles into interlocking relationship as the slider is moved in the closing direction;

(v) a separator plow extending from the second region of the top member into the open volume between the legs; the separator plow adapted to wedge between opposing tracks and unlock the profiles as the slider device is moved in the opening direction along the zipper closure leading with the closing end and trailing with the opening end; and (vi) the second region of the top member including the first end stop engagement surface positioned to strike the first end stop, when the zipper closure has been unlocked;

wherein the first end stop and the second end stop are each an inverted U-clip; and wherein the first end stop engagement surface is between the separator plow and the closing end.

* * * * *